US011214456B2

(12) United States Patent
Janek et al.

(10) Patent No.: US 11,214,456 B2
(45) Date of Patent: Jan. 4, 2022

(54) METHOD AND ARRANGEMENT FOR DETECTING A FILLING LEVEL IN A TISSUE DISPENSER

(71) Applicant: CWS-boco International GmbH, Duisburg (DE)

(72) Inventors: Peter Janek, Züntersbach (DE); Sascha Scheler, Frankfurt (DE)

(73) Assignee: CWS INTERNATIONAL GMBH, Duisburg (DE)

( * ) Notice: Subject to any disclaimer, the term of this patent is extended or adjusted under 35 U.S.C. 154(b) by 0 days.

(21) Appl. No.: 16/936,548

(22) Filed: Jul. 23, 2020

(65) Prior Publication Data

US 2021/0032063 A1 Feb. 4, 2021

(30) Foreign Application Priority Data

Aug. 2, 2019 (EP) ..... 19189785

(51) Int. Cl.

| | |
|---|---|
| ***B65H 26/06*** | (2006.01) |
| ***A47K 10/36*** | (2006.01) |
| ***A47K 10/38*** | (2006.01) |
| ***B65H 16/00*** | (2006.01) |
| *A47K 10/32* | (2006.01) |

(52) U.S. Cl.

CPC ..... *B65H 26/06* (2013.01); *A47K 10/36* (2013.01); *A47K 10/38* (2013.01); *B65H 16/005* (2013.01); *A47K 2010/3226* (2013.01); *A47K 2010/3693* (2013.01); *B65H 2511/114* (2013.01); *B65H 2701/1924* (2013.01)

(58) Field of Classification Search

CPC ..... B65H 26/06; B65H 2701/1924; B65H 2511/114; B65H 16/005; A47K 2010/3226; A47K 2010/36; A47K 2010/38; A47K 2010/3687

See application file for complete search history.

(56) References Cited

U.S. PATENT DOCUMENTS

| | | | | |
|---|---|---|---|---|
| 5,762,283 | A * | 6/1998 | Buchmeyer | B65H 19/102 242/532.3 |
| 5,938,354 | A * | 8/1999 | Yasui | B41J 11/46 400/621 |
| 7,783,380 | B2 | 8/2010 | York et al. | |
| 7,828,240 | B2 | 11/2010 | Hagleitner | |
| 2002/0197091 | A1* | 12/2002 | Otsuki | B65H 26/06 400/582 |

(Continued)

FOREIGN PATENT DOCUMENTS

| | | |
|---|---|---|
| CN | 103784072 A | 5/2014 |
| EP | 2299887 A2 | 3/2011 |

(Continued)

*Primary Examiner* — Michael E Gallion

(74) *Attorney, Agent, or Firm* — Price Heneveld LLP

(57) ABSTRACT

A method and an arrangement for detecting a filling level in a tissue dispenser for dispensing portions of a continuous web of tissue from a tissue roll is adapted for use with. a tissue dispenser for dispensing portions of the continuous web of tissue from the tissue roll. The method comprises the steps of counting portions of the tissue dispensed by the tissue dispenser, determining an initial filling level depending on the counter data and an initial tissue type information, and determining a verified filling level depending on the counter data when a roll exchange of a tissue roll from a first tissue roll position to a second tissue roll position in the tissue dispenser has occurred.

10 Claims, 26 Drawing Sheets

(56) References Cited

U.S. PATENT DOCUMENTS

| | | | | |
|---|---|---|---|---|
| 2009/0314874 | A1* | 12/2009 | Kling | A47K 10/38 242/560 |
| 2015/0259168 | A1* | 9/2015 | Inoue | B65H 19/12 242/553 |
| 2017/0057775 | A1 | 3/2017 | Kobs et al. | |
| 2018/0177348 | A1 | 6/2018 | Swanson et al. | |
| 2018/0263435 | A1* | 9/2018 | Osborne, Jr. | B65H 35/006 |
| 2018/0368626 | A1* | 12/2018 | Williams, Jr. | G06F 9/542 |
| 2018/0368627 | A1 | 12/2018 | Ghazi | |
| 2019/0208967 | A1* | 7/2019 | Williams, Jr. | A47K 10/3662 |

FOREIGN PATENT DOCUMENTS

| | | | |
|---|---|---|---|
| EP | 2366316 | A1 | 9/2011 |
| EP | 2816941 | A2 | 12/2014 |
| EP | 2816942 | A2 | 12/2014 |
| EP | 3295851 | A1 | 3/2018 |
| EP | 3603470 | A1 | 2/2020 |
| EP | 3603471 | A1 | 2/2020 |
| JP | 2006043110 | | 2/2006 |
| JP | 2007525258 | | 9/2007 |
| JP | 2010233971 | | 10/2010 |
| WO | 2005006932 | A1 | 1/2005 |
| WO | 2009135241 | A2 | 11/2009 |
| WO | 2010046662 | A1 | 4/2010 |
| WO | 2013113129 | A1 | 8/2013 |
| WO | 2013123535 | A2 | 8/2013 |
| WO | 2015166034 | A1 | 11/2015 |
| WO | 2016015067 | A1 | 2/2016 |
| WO | 2017188973 | A1 | 11/2017 |
| WO | 2017193151 | A1 | 11/2017 |
| WO | 2019055024 | A1 | 3/2019 |

* cited by examiner

METHOD AND ARRANGEMENT FOR DETECTING A FILLING LEVEL IN A TISSUE DISPENSER

CROSS-REFERENCE TO FOREIGN PRIORITY APPLICATION

The present application claims the benefit under 35 U.S.C. §§ 119(b), 119(e), 120, and/or 365(c) of European Application No. EP 19189785.9 filed Aug. 2, 2019.

FIELD OF THE INVENTION

The invention relates to a method and an arrangement for detecting a filling level in a tissue dispenser for dispensing portions of a continuous web of tissue from a tissue roll. Further, the invention relates to a tissue dispenser for dispensing portions of a continuous web of tissue from a tissue roll and a dispenser system.

BACKGROUND OF THE INVENTION

The main application area for such tissue dispensers are washrooms and other hygienic environments. Dispensers and methods for dispensing portions of a continuous web of tissue from a tissue roll are known, for example, from WO 2015/166034 A1, WO 2009/135241 A2, WO 2010/046662 A1, WO 2017/193151 A1, EP 2 816 941 B1, EP 2 816 942 B1, EP 3 295 851 A1, EP 2 299 887 B1, WO 2016/015067 A1, WO 2013/123535 A2, U.S. Pat. No. 7,828,240 B2, WO 2005/006932 A1, EP 2 366 316 B1, WO 2013/113129 A1, WO 2019/055024 A1 as well as European patent applications EP 18186308 and EP 18186332.

Existing solutions, however, have a number of drawbacks. For example, providing a dispenser with a refill of a tissue roll and/or providing enough tissue capacity within a dispenser for a high number of users is a challenge. In particular, the amount of resource left in a dispenser as well as further information about the resource and/or the dispenser and its environment is often not known or incorrect. Thus, dispensers are often serviced at the wrong time and/or are operated with the wrong resource and/or under wrong (operating) conditions.

SUMMARY OF THE INVENTION

Therefore, it is an object of the present invention to provide an improved method and an improved arrangement for detecting a filling level in a tissue dispenser for dispensing portions of a continuous web of tissue from a tissue roll as well as an improved tissue dispenser. In particular, it is an object of the present invention to provide a method and an arrangement for detecting a filling level in a tissue dispenser for dispensing portions of a continuous web of tissue from a tissue roll as well as a tissue dispenser, which reduce or eliminate one or more of the above-mentioned disadvantages. Further, it is an object of the present invention to provide a method and an arrangement for detecting a filling level in a tissue dispenser for dispensing portions of a continuous web of tissue from a tissue roll as well as a tissue dispenser, which are reliable and/or enable reliable and/or cost-efficient and/or improved operation and/or maintenance of a tissue dispenser.

According to a first aspect, a method is provided for detecting a filling level in a tissue dispenser for dispensing portions of a continuous web of tissue from a tissue roll, the method comprising: counting portions of the tissue dispensed by the tissue dispenser, determining an initial filling level depending on the counter data and an initial tissue type information, determining a verified filling level depending on the counter data when a roll exchange of a tissue roll from a first tissue roll position to a second tissue roll position in the tissue dispenser has occurred.

According to a further aspect, an arrangement is provided for detecting a filling level in a tissue dispenser for dispensing portions of a continuous web of tissue from a tissue roll, the arrangement comprising a counter adapted to count portions of the tissue dispensed by the tissue dispenser, a control unit adapted to receive counter data from the counter, wherein the control unit is adapted to determine an initial filling level depending on the counter data and an initial tissue type information, wherein the control unit is adapted to determine a verified filling level depending on the counter data when a roll exchange of a tissue roll from a first tissue roll position to a second tissue roll position in the tissue dispenser has occurred.

According to a further aspect, a tissue dispenser is provided comprising an arrangement for detecting a filling level in a tissue dispenser as described herein.

According to a further aspect, a dispenser system is provided comprising a plurality of tissue dispensers as described herein, a backend unit, and a plurality of mobile devices, and preferably an external communication unit.

As to the advantages, preferred embodiments, and details of the aspects of the invention and their preferred embodiments, reference is made to the advantages, preferred embodiments, and details described herein below. In particular, the advantages, preferred embodiments and details described herein below apply, mutatis mutandis, to all aspects of the invention mentioned herein, respectively. For example, the arrangement for detecting a filling level in a tissue dispenser for dispensing portions of a continuous web of tissue from a tissue roll and its preferred embodiments are suitable for carrying out the method for detecting a filling level in a tissue dispenser for dispensing portions of a continuous web of tissue from a tissue roll and its preferred embodiments. Further, for example, the tissue dispenser and its preferred embodiments comprise the arrangement for detecting a filling level in a tissue dispenser for dispensing portions of a continuous web of tissue from a tissue roll and possibly its preferred embodiments and/or the tissue dispenser and its preferred embodiments are suitable to carry out the method for detecting a filling level in a tissue dispenser for dispensing portions of a continuous web of tissue from a tissue roll and its preferred embodiments. Further, for example, the method for detecting a filling level in a tissue dispenser for dispensing portions of a continuous web of tissue from a tissue roll and its preferred embodiments preferably is carried out by the arrangement for detecting a filling level in a tissue dispenser for dispensing portions of a continuous web of tissue from a tissue roll and its preferred embodiments and/or by the tissue dispenser, and its preferred embodiments. Thus, the following description of advantages, preferred embodiments and details applies to all aspects of the invention, respectively, where applicable.

In the following, initially the dispenser and its component, functions, and advantageous embodiments will be described.

The tissue dispenser is preferably suitable for washrooms and other hygienic environments, like hospitals. The tissue to be dispensed from the dispenser can be a single use tissue, such as a paper towel, or a multiuse tissue, such as a cloth towel or microfiber towel. The tissue is dispensed in portions, which preferably means a certain length of tissue to be used by a user, often for drying hands. The dispensed portion can be discarded after use. For example, a portion can be removed from the continuous web of tissue by tearing or cutting the portion. The tissue can be perforated at intervals to facilitate tearing or cutting.

Further, in particular, in multiuse tissue dispensers, the dispensed and used portion of tissue can be retrieved and coiled, for example within the dispenser. Usually, the used multiuse tissue is removed by service personnel, washed and recycled, and then provided for a further use cycle. Once a tissue roll is empty, usually a new tissue roll, which also can be a recycled tissue roll, is inserted into the dispenser and received there by some form of holding arrangement.

The tissue dispenser preferably comprises a first tissue roll position for receiving a tissue roll and a second tissue roll position for receiving a tissue roll, wherein the first tissue roll position is a receiving position for receiving a new tissue roll, and wherein the second tissue roll position is a receiving position for receiving the tissue roll from the first tissue roll position.

Preferably, the first tissue roll position is a first dispensing position for dispensing tissue from the tissue roll. Further, preferably the second tissue roll position is a second dispensing position for dispensing tissue from the tissue roll.

An empty tissue roll position is preferably present when no tissue roll is in the second tissue roll position and/or when no tissue is left on a tissue roll in the second tissue roll position, for example, when only the axle of an empty tissue roll is present in the second tissue roll position.

Preferably, the first tissue roll position is a receiving position for receiving a new refill tissue roll. In particular, the receiving position for receiving a new tissue roll and the first tissue roll position are identical positions, i.e., no movement of the tissue roll after its insertion into a dispenser by service personnel to a dispensing position for dispensing tissue is needed. Further, preferably, the first tissue roll position remains unchanged during dispensing of tissue from a tissue roll in the first tissue roll position, i.e., while the diameter of the tissue roll in the first tissue roll position is gradually reduced, the tissue roll remains in the first tissue roll position, in particular, there is no movement of the tissue roll into another position or a change of the first tissue roll position.

In particular, it is preferred that a dispenser comprises a housing with an openable housing cover and a housing base for wall-mounting the dispenser; and/or a dispensing opening; and/or a cutting unit; and/or a user interface; and/or a proximity sensor for detecting the presence of a user.

For example, a proximity sensor for detecting the presence of the user can be provided. In particular, such a proximity sensor for detecting the presence of the user can be in the form of a hand sensor. Further, preferably, a dispensing action is triggered when the proximity sensor detects the presence of the user. In particular, this is preferred for an automatically driven output mechanism. Alternatively, the output mechanism can be manually driven, for example, by a pulling force exerted by the user and/or by providing an output lever or the like for manual handling by a user.

Further, it is preferred that a dispenser comprises an output mechanism; and/or a transfer mechanism; and/or a holding arrangement.

In particular, a tissue dispenser further preferably comprises an output mechanism for supplying portions of tissue, wherein the output mechanism preferably comprises at least two output rollers, in particular, a driven roller and a tension roller.

The output mechanism preferably supplies portions of tissue from the tissue roll, preferably to a dispensing opening of the dispenser. Further preferably, the output mechanism is suitable for supplying portions of tissue from a tissue roll in the first position and/or for supplying portions of a tissue from a tissue roll in the second tissue roll position. The output mechanism can be a manual output mechanism or an automatic output mechanism, in particular, a driven output mechanism, preferably electrically driven, e.g., via a battery supply and/or other energy supply.

It is particularly preferred that the output mechanism comprises at least two output rollers, preferably a driven roller and a tension roller, with an output gap between the output rollers. Preferably, at least one of the two output rollers has at least one recess, preferably in the form of a reduced diameter. It is particularly preferred that the transfer mechanism, preferably the at least one retainer flap, comprises at least one transfer projection for projecting into the at least one recess of the at least one of the two output rollers in the hand-over position.

Portions of a continuous web of tissue can be supplied by an output mechanism through an output gap between at least two output rollers in an advantageous way. By providing at least one of the two output rollers with at least one recess, preferably in the form of a reduced diameter, it is possible to have a transfer projection projecting into this at least one recess. Preferably, along an axial extension of the output roller, two, three, or more recesses are formed. Further preferably, two, three, or more retainer flaps comprising at least one transfer projection for projecting into the respective recesses at the output roller are provided. This projection of the transfer projection into the recess in the handover position facilitates the transfer of the end of the tissue and to release the tissue from the transfer mechanism and to reliably insert the tissue into the gap between the two output rollers.

Preferably, the output gap between the output rollers is adjustable. Further, preferably, the output gap between the output rollers is biased, preferably via a biasing element, such as a spring, in a position where the output roller contact each other. In particular, is it preferred that the output gap and/or the output rollers is/are adapted to accommodate kinds of tissue with different thickness and/or one, two, or several layers of tissue. In particular, it is preferred that one of the output rollers is in a fixed position and the other output roller is in a moveable position, and preferably biased toward the fixed output roller.

In particular, tissue dispenser further preferably comprises a transfer mechanism for releasably holding and transferring an end of a tissue roll in the first tissue roll position to the output mechanism; wherein the transfer mechanism is adapted to transfer the end of the tissue roll in the first tissue roll position to the output mechanism when the second tissue roll position is empty, and wherein preferably the transfer mechanism is adapted to transfer the end of the tissue roll in the first tissue roll position to the output mechanism independent from the direction of unrolling of the tissue roll in the first tissue roll position.

It is further preferred that the transfer mechanism is adapted to transfer the end of the tissue roll in the first tissue roll position to the output mechanism when the tissue sensor indicates that there is no tissue connection from a tissue roll in the second tissue roll position to the output mechanism.

In particular, it is preferred that the transfer mechanism is adapted to transfer the end of the tissue roll in the first tissue roll position to the output mechanism only when the tissue sensor indicates that there is no tissue connection from a tissue roll in the second tissue roll position to the output mechanism.

A transfer mechanism is preferably provided, which is adapted to releasably hold an end of a tissue roll in the first tissue roll position. Preferably, the first tissue roll position is the receiving position for receiving a refill tissue roll by service personnel. Further, preferably, the second tissue roll position is a position for a further tissue roll. This further or spare tissue roll can be placed in the second tissue roll position by service personnel and/or automatically, in case the full refill tissue roll in the first tissue roll position has become a reduced diameter tissue roll and is, preferably by gravity, transferred within the dispenser from the first tissue roll position to the second tissue roll position.

The transfer mechanism is further preferably adapted to transfer the end of the tissue roll in the first tissue roll position to the output mechanism. In particular, this is to be understood that the transfer mechanism actually handles the insertion of the end of a tissue roll in the first tissue roll position to the output mechanism, which means that this action does not need to be performed by service personnel. Upon inserting a refill tissue roll into the first tissue roll position, the service personnel preferably only have to insert the end of the tissue roll into the transfer mechanism.

The transfer mechanism is further preferably adapted to transfer the end of the tissue roll in the first tissue roll position to the output mechanism when the second tissue roll position is empty.

A combination comprising an output mechanism and a transfer mechanism as described herein can be referred to as a dispenser module. Preferably, the output mechanism and/or the transfer mechanism and/or the dispenser module can be provided as separate units, which can be mounted and used in a dispenser and/or which can be exchanged. Further, preferably, the output mechanism and/or the transfer mechanism and/or the dispenser module are adapted as retro-fit units for fitting into existing dispensers.

Preferably, the transfer mechanism is adapted to release the end of the tissue roll when the end is inserted into the output mechanism and/or gripped by the output mechanism and/or conveyed by the output mechanism in a supplying operation to supply a portion of tissue to a dispensing opening. Preferably, the transfer mechanism is thus adapted to releasably hold the end of a tissue roll and to release the end of a tissue roll once a predetermined force, particularly a pulling force, is exerted on the end of the tissue roll, preferably by the output mechanism.

It is particularly preferred that the transfer mechanism is adapted to transfer the end of the tissue roll in the first tissue roll position to the output mechanism only when the second tissue roll position is empty.

A direction of unrolling the tissue roll in the first tissue roll position can be clockwise or anti-clockwise, from an axis of rotation of the tissue roll. During servicing of a dispenser, in particular, during refilling a tissue roll and/or inserting the tissue roll into the first tissue roll position, it is advantageous that the service personnel do not need to pay specific attention to the direction of unrolling of the tissue roll after insertion. Rather, the tissue roll can be inserted in any of the two directions of unrolling, since the transfer mechanism is adapted to releasably hold and transfer the end of the tissue roll in the first tissue roll position to the output mechanism independently of the direction of unrolling.

It is particularly preferred that a dispenser comprises a detector for detecting whether the second tissue roll position is empty and/or a tissue sensor for detecting the presence of a tissue connection from a tissue roll in the second tissue roll position to the output mechanism. Preferably, whether the second tissue roll position is empty or not is detected before the transfer mechanism transfers the end of a tissue roll in the first tissue roll position to the output mechanism. This detection can be carried out by a control unit, for example. Further, a detector for detecting whether the second tissue roll position is empty or not can be provided. Preferably, the detector is an optical detector.

In particular, the tissue dispenser further preferably comprises a holding arrangement. The holding arrangement preferably comprises a holding mechanism, a diameter sensor, and a shift mechanism. Preferably, the holding mechanism is for holding a tissue roll in a first tissue roll position; wherein the holding mechanism preferably comprises a first holding element for engaging a first end of an axle of the tissue roll and a second holding element for engaging a second end of the axle of the tissue roll. Preferably, the diameter sensor is for detecting the diameter of a tissue roll in the first tissue roll position. Preferably, the shift mechanism connects the holding mechanism and the diameter sensor. Preferably, the shift mechanism is adapted for shifting the holding mechanism, in particular, the first and second holding elements, from a hold position to a release position and vice versa.

Preferably, the dispenser comprises a holding arrangement for holding a tissue roll in a dispenser for dispensing portions of a continuous web of tissue from a tissue roll, the holding mechanism comprising a holding mechanism for holding a tissue roll in a first tissue roll position; wherein the holding mechanism comprises a first holding element for engaging a first end of an axle of the tissue roll and a second holding element for engaging a second end of the axle of the tissue roll; a diameter sensor for detecting the diameter of a tissue roll in the first tissue roll position; and a shift mechanism connecting the holding mechanism and the diameter sensor; wherein the shift mechanism is adapted for shifting the holding mechanism, in particular, the first and second holding elements, from a hold position to a release position and vice versa; wherein a distance between the first holding element and the second holding element in the release position is larger than a distance between the first holding element and the second holding element in the hold position.

Preferably, the holding arrangement is adapted to releasably hold a tissue roll and to release the tissue roll, as will be described later in detail.

The holding arrangement preferably is suitable for holding a tissue roll in a dispenser. In particular, the holding mechanism is adapted to hold a tissue roll such that the tissue roll can be rotated in a direction of unrolling, such that portions of tissue can be supplied from the continuous web of tissue coiled on the tissue roll. In particular, the holding mechanism is adapted to hold an axle of a tissue roll in a releasable and rotatable manner. The axle of the tissue roll can be a hollow axle or a full axle. The axle of a tissue roll can protrude in an axial direction from the tissue roll at one or both ends of the axle or end flush with the end of the coiled tissue of the tissue roll.

The holding mechanism preferably comprises first and second holding elements for engaging first and second ends of the axle of the tissue roll. For example, a holding element can be in the form of a cylindrical stub for protruding into an end of a hollow axle of the tissue roll. A holding element can also be in the form of a form fit piece into which an end of the axle protruding from the coiled tissue of the tissue roll can be inserted. In general, it is preferred that the engagement between the first and second holding elements of the holding mechanism and the first and second ends of the axle of the tissue roll provides sufficient support to reliably hold the axle of the tissue roll during rotation of the tissue roll in an unrolling direction for supply of tissue. It is particularly preferred that the holding mechanism provides full support of the axle of the tissue roll, which preferably means that no additional elements of the holding arrangement or the dispenser are needed in providing support for and/or guidance for the axle of the tissue roll.

It is particularly preferred that the holding mechanism, in particular, the first holding element and the second holding element, is adapted to provide operative support for the tissue roll during operation of the dispenser, in particular, during dispensing of tissue.

Preferably, the holding mechanism is adapted to provide full and/or the sole operational support for the tissue roll during operation of the dispenser, in particular, during dispensing of tissue.

In general, it is preferred that the engagement between the first and second holding elements of the holding mechanism and the first and second ends of the axle of the tissue roll can be realized, for example, by an engagement of protrusions of the first and second holding elements with respective recesses in the first and second ends of the axle of the tissue roll or by an engagement of recesses of the first and second holding elements with respective protrusions in the first and second ends of the axle of the tissue roll. Further engagement solutions, such as a combination of recesses and protrusion, and/or magnetic connections, for example, are possible.

The holding arrangement further preferably comprises a diameter sensor for detecting the diameter of a tissue roll in the first tissue roll position. Preferably, the diameter sensor is a mechanical sensor adapted to detect the diameter of a tissue roll by contacting the outer periphery of the tissue roll and changing its position with the reduced diameter of the tissue roll, which is reduced by supplying portions of the continuous web of tissue coiled on the tissue roll.

Further, the holding arrangement preferably comprises a shift mechanism connecting the holding mechanism and the diameter sensor. The shift mechanism is adapted to shift the holding mechanism from a hold position to a release position and vice versa. In particular, the shift mechanism is adapted to shift the first and second holding elements from a hold position to a release position and vice versa.

Preferably, in the hold position, a distance, in particular, a horizontal distance and/or a distance in an axial direction of the tissue roll, between the first and second holding elements is smaller than a distance, in particular, a horizontal distance and/or a distance in an axial direction of the tissue roll, between the first and second holding elements in the release position. The distance between the first and second holding elements in the hold position preferably is dimensioned such that the axle of a tissue roll in the first tissue roll position can be reliably held.

Further preferably, the distance between the first and second holding elements in the release position is dimensioned such that the axle of the tissue roll is free from contact with the first and/or the second holding element. Preferably, in the release position a distance, in particular, a horizontal distance and/or a distance in an axial direction of the tissue roll, is present between the first holding element and the first end of the axle of the tissue roll and between the second holding element and the second end of the axle of the tissue roll. This way, and in particular, since the holding mechanism is the only support for the tissue roll, no support is present for the tissue roll in the release position and the tissue roll is free to fall down under gravity. Preferably, after being held in the first tissue roll position by the holding arrangement in the hold position, the holding arrangement comes into the release position and the tissue roll is released from the first tissue roll position and preferably moves into a second tissue roll position of a dispenser. Preferably, during this movement the axle of the tissue roll, in particular, each end of the axle, is unguided, in particular, not guided in a guide rail contacting the axle.

By preferably holding a tissue roll in the first tissue roll position in a secure and reliable manner, it is possible to supply portions of a continuous web of tissue from the tissue roll in this first tissue roll position and to detect the diameter, in particular, a reduced diameter, of the tissue roll in this first tissue roll position by the diameter sensor. At the same time, by preferably moving the first and second holding elements away from the axle of the tissue roll in the release position by increasing the distance between the first and second holding elements via the shift mechanism, a reliable and preferably full release of the tissue roll from the first tissue roll position is effected. In other words, while the holding elements preferably hold the tissue roll in the first tissue roll position in the hold position, the tissue roll is released for freefall by spacing the holding elements from the tissue roll, in particular, an axle of the tissue roll, in the release position.

The preferable solution regarding the holding mechanism described herein does not need guide rails and additional stopping elements. Rather, the larger distance between the holding elements in the release position allows the insertion of a refill roll directly into the first tissue roll position, so that the tissue roll does not need to travel from an insertion position to a dispensing position. Rather, the tissue roll, preferably, can be inserted directly in the first tissue roll position when the holding mechanism is in the release position and the tissue roll will be held in that same first tissue roll position by the holding mechanism in the hold position. Shifting the hold mechanism into the release position preferably frees the tissue roll from its support and allows the freefall of the tissue roll, in particular, by gravity only. In particular, it is preferred that the first tissue roll position is a first dispensing position for dispensing tissue from the tissue roll. Further, preferably, the first tissue roll position is a receiving position for receiving a new tissue roll.

According to a preferred embodiment the shift mechanism is adapted for shifting the holding mechanism, in particular, the first and second holding elements, from the hold position to the release position when the diameter sensor detects a reduced tissue roll diameter in the first tissue roll position.

Further, it is preferred that the shift mechanism is adapted for shifting the holding mechanism, in particular, the first and second holding elements, from the release position to the hold position when the diameter sensor detects a full tissue roll diameter in the first tissue roll position.

Preferably, the holding arrangement and its components are adapted to shift the holding mechanism between the hold position and the release position depending on the diameter of a tissue roll in the first tissue roll position detected by the diameter sensor. When a full tissue roll diameter in the first tissue roll position is detected by the diameter sensor, preferably by a movement of the diameter sensor into a position corresponding to a full tissue roll diameter, the shift mechanism shifts the holding mechanism, in particular, the first and second holding elements, from the release position to the hold position to hold the full tissue roll present in the first tissue roll position.

Further, preferably, when the tissue roll in the first tissue roll position is reduced in its diameter due to supply of portions of tissue from the continuous web of tissue coiled on the tissue roll, the diameter sensor detects such a reduced tissue roll diameter, preferably by being in a position corresponding to such a reduced tissue roll diameter. When the diameter sensor detects this reduced tissue roll diameter, the shifting mechanism shifts the holding mechanism, in particular, the first and second holding elements, from the hold position to the release position.

By coupling the activation of the shifting mechanism to the detection of different tissue roll diameters, it is possible to keep a refill tissue roll in the first tissue roll position until a certain reduced diameter of this tissue roll is reached, i.e., until a certain amount of tissue has been dispensed from this tissue roll. For example, it can be preferred that a dispenser in which the holding arrangement is used, has a second tissue roll position, in which a spare tissue roll can be received. Preferably, such a spare tissue roll is a tissue roll with a reduced diameter, i.e., a tissue roll which only has a reduced amount of continuous web of tissue left to be dispensed. In this way, a dispenser can continue to dispense portions of tissue from the remaining amount of continuous web of tissue present on the reduced diameter tissue roll in the second tissue roll position, while the first tissue roll position is empty. Thereby, the time span for dispensing the remaining tissue from the tissue roll in the second tissue roll position can be used by service personnel for providing a new refill tissue roll in the first tissue roll position.

Further, it is preferred that a dispenser comprises a level indicator; and/or a tissue roll axle receptacle; and/or an axle opening.

Further, it is preferred that a dispenser comprises a control unit. Preferably, a control unit is provided which is adapted to activate the transfer mechanism to initiate the movement from the service position to the handover position once the detector or tissue sensor has signaled that the second tissue roll position is empty. Further, preferably, the control unit is adapted to initiate the movement of the transfer mechanism from the service position to the handover position in the first dispensing action following the detection of an empty second tissue roll position. In particular, a dispensing action can be understood to be the supply of a portion of tissue to a user, either manually or automatically, and can comprise a respective request from a user, e.g., by pulling a handle or bringing a hand into the proximity of a proximity sensor.

In general, it is preferred that a control unit is present, which preferably is connected to various components of the dispenser using a wired or wireless connection in order to transfer signals, e.g., sensor signals, activation signals, control signals, and the like, and to generate and/or process and/or receive and/or transmit such signals. Further, preferably, the control unit may, using either a wireless or wired connection, also be connected to external components, for example, a washroom information system, an external communication unit, or a backend unit.

Further, preferably, tissue dispenser comprises an operator interface adapted to display and/or to adjust a setting for the proximity sensor and/or a setting for the dispensing mode. The operator interface preferably is arranged at a location of the dispenser which is not accessible by a user or at least not in the usual field of vision of a user during normal operation of the dispenser, but which is only accessible to service personnel, e.g., via opening the housing cover.

In the following, new details, functions, and advantageous embodiments of the method and arrangement for detecting a filling level in a tissue dispenser will be described.

The method for detecting a filling level in a tissue dispenser comprises counting portions of the tissue dispensed by the tissue dispenser, determining an initial filling level depending on the counter data and an initial tissue type information, and determining a verified filling level depending on the counter data when a roll exchange of a tissue roll from a first tissue roll position to a second tissue roll position in the tissue dispenser has occurred.

The arrangement for detecting a filling level in a tissue dispenser comprises a counter adapted to count portions of the tissue dispensed by the tissue dispenser, a control unit adapted to receive counter data from the counter, wherein the control unit is adapted to determine an initial filling level depending on the counter data and an initial tissue type information, wherein the control unit is adapted to determine a verified filling level depending on the counter data when a roll exchange of a tissue roll from a first tissue roll position to a second tissue roll position in the tissue dispenser has occurred.

For detecting of the filling level in a tissue dispenser as described herein, the portions of tissue dispensed by the tissue dispenser are counted. Preferably, for each portion of tissue dispensed by the tissue dispenser, the counter data is incremented. Based on the counter data and an initial tissue type information, an initial filling level is determined.

A tissue type information preferably comprises information on one or more of the following:

- length of tissue on the tissue roll (also referred to as roll length),
- width of tissue (also referred to as tissue width),
- number of layers (e.g., two-layer tissue or three-layer tissue),
- thickness of tissue,
- tissue material,
- single use or multiuse tissue,
- information on the tissue roll axle (also referred to as tissue roll core), such as diameter of the tissue roll axle, material of the tissue roll axle, diameter of the tissue roll axle, extension of the tissue roll axle along the tissue width, one-piece axle or two- or multiple-piece axle,
- etc.

An initial tissue type information preferably is an information which is set in a default, in particular, upon first installation and/or as soon as a new tissue roll is installed in the first tissue roll position of a tissue dispenser. Preferably, information used as initial tissue type information corresponds to a standard tissue type, which is used often throughout high number of tissue dispensers. For example, the initial tissue type information can be stored in an arrangement for detecting a filling level in a tissue dispenser, for example, on a control unit, and/or in the tissue dispenser and/or in an external communication unit and/or in a backend unit.

The initial filling level preferably corresponds to the filling level which is derived from the initial tissue type information with the counter data at the time of determination. In particular, the initial filling level preferably corresponds to the filling level which is derived from the counter data at the time of determination as long as no verified tissue type information has been determined. In particular, the initial filling level preferably corresponds to the filling level which is derived from the initial tissue type information with the counter data at the time of determination not only in the very beginning of a dispensing cycle, when the counter data typically is zero, but also during the time when the dispenser is operated and dispenses paper.

Typically, when the initial filling level is determined for the first time, the counter data is zero. However, in certain circumstances, the counter data at the time of determining the initial filling level can be different from zero.

For example, when the counter data at the time of determination of the initial filling level is zero, the initial filling level can be 100%. For example, if the initial tissue type information is two-layer, single use tissue paper with a roll of length of 150 meter and with a portion size of 25 cm, 600 portions can be dispensed from a tissue roll with this initial tissue type information. If the counter data corresponds to zero, the full length of 150 m and the full amount of portions of 600 tissue portions is present and the initial filling level is 100%.

When the dispenser starts dispensing tissue, the counter data is incremented accordingly. Thus, at different times during the dispensing cycle, the initial filling level can be determined with this incremented counter data and the initial tissue type information. For example, if the initial tissue type information is two-layer single use tissue paper with a roll of length of 150 meter and with a portion size of 25 cm and 100 portions have been dispensed from a tissue roll with this initial tissue type information, the initial filling level will be about 83%. When the dispensing cycle continues and another 100 portions have been dispensed (i.e., 200 portions in total), the initial filling level will be about 67%.

Thus, the initial filling level is to be understood as a filling level which is determined based on the initial tissue type information. In particular, the initial filling level is to be understood as a filling level which can not only be determined at the time of installation of a new roll or at the beginning of a dispensing cycle, but at any time during the dispensing cycle, as long as the initial tissue type information is used for the determination together with the current counter data at the time of the determination.

Further, when a roll exchange of tissue roll from a first tissue roll position to a second tissue roll position in the tissue dispenser has occurred or has been detected, a verified filling level depending on the counter data is determined. When a tissue roll changes its position from a first tissue roll position to a second tissue roll position, preferably certain conditions are met. These conditions can be, for example, that the diameter of the tissue roll has been reduced by or to a certain amount, for example, in order for the tissue roll to fit into a possibly smaller, second tissue roll position. Thus, taking into account this event of the change in position of the tissue roll and the counter data corresponding to this time of exchange of a tissue roll from a first tissue roll position to a second tissue roll position, a verified filling level can be determined.

For example, if the initial tissue type information contained information on two-layer, single use paper with a roll length of 150 m and a portion size of 25 cm, it can be calculated, whether the reduced diameter of the tissue roll at the time of the roll exchange corresponds to the counter data at the time of the roll exchange. For example, when instead of a two-layer, single use paper with a roll length of 150 meter a three-layer, single use paper with a roll length of 100 m and a portion size of 25 cm has been used, a lower number of tissue portions will have been dispensed to reach the reduced diameter at the time of the roll exchange then for the two-layer, single use paper with a roll length of 150 meter. Thus, the counter data at the time of the roll exchange indicates whether the initial tissue type information applies to the type of tissue actually present in the tissue dispenser, or whether a different tissue type has been used and the filling level needs to be adjusted. Further, the mistakes in determination of the initial filling level can be compensated by verifying the filling level at the time of the roll exchange by the counter data present at the time of the roll exchange.

Preferably, the determination of the verified filling level further depends on data relating to the roll exchange, in particular, a reduced diameter of the tissue roll at the time of the roll exchange and/or a maximum diameter of the tissue roll in the second tissue roll position and/or an amount of tissue used before the roll exchange occurs.

Preferably, an initial filing level and/or the initial tissue type information and/or the verified filing level and/or the verified tissue type information are to be understood as the initial current filing level and/or initial current tissue type information and/or the verified current filing level and/or verified current tissue type information, in particular, at the time of determination. Further, preferably, the counter data from the counter is to be understood as the current counter data from the counter, in particular, at the time of determination.

The time when a roll exchange of a tissue roll from a first tissue roll position to a second tissue roll position in the tissue dispenser is preferably detected, e.g., as described herein with respect to further components of the dispenser and/or the arrangement and/or the control unit. Thus, when it is described herein, the time when the roll exchange of a tissue roll from a first tissue roll position to a second tissue roll position in the tissue dispenser has occurred, it is preferably the time when the roll exchange of a tissue roll from a first tissue roll position to a second tissue roll position in the tissue dispenser has been detected.

The counter adapted to count portions of the tissue dispensed by the tissue dispenser preferably is adapted to generate counter data corresponding to the portions counted. Preferably, a dispensed portion of the tissue is counted when a dispensing action is performed, for example, manually by a user and/or by a driven and/or automated dispensing mechanism, e.g., in the form of an output mechanism. For example, the activation of a dispensing drive can be counted as a dispensed portion.

Preferably, the filling level in a tissue dispenser can be understood as the percentage of tissue currently remaining in a tissue dispenser compared to the tissue present on a new tissue roll. Further, the filling level in a tissue dispenser can be understood as the percentage of a number of tissue portions currently remaining in a tissue dispenser versus the number of tissue portions present on a new tissue roll. In particular, the filling level in a tissue dispenser can be an accumulated value of two tissue rolls in a tissue dispenser, e.g., the accumulated value of a tissue roll in the first tissue roll position and in a second tissue roll position.

Further, it can be preferred that a displayed filling level is not more than 100%, even if the tissue or number of tissue portions present in a tissue dispenser exceeds the maximum tissue or number of tissue portions of a new tissue roll.

In this way, the detection of a filling level can be much more reliable and accurate, since a defined event, namely, the exchange of a tissue roll from the first tissue roll position to a second tissue roll position in the tissue dispenser, and the counter data present at this time, is used to verify the filling level which was originally determined based on an initial tissue type information. The step of verifying the filling level at a predetermined event improves reliability and accuracy of the filling level detection.

The method preferably comprises determining a verified tissue type information when a roll exchange of a tissue roll from a first tissue roll position to a second tissue roll position in the tissue dispenser has occurred.

The control unit preferably is adapted to determine a verified tissue type information when a roll exchange of a tissue roll from a first tissue roll position to a second tissue roll position in the tissue dispenser has occurred.

It is preferred that at the time of the roll exchange a verified tissue type information is also determined, while the verified filling level can also be determined independent from a verified tissue type information, for example, due to other mistakes or incorrect counter data at the time of determining the initial filling level. Very often incorrect filling level is due to the fact that the tissue type present in the tissue dispenser does not correspond to the tissue type information stored in the tissue dispenser. Therefore, verifying the tissue type information at the time of a roll exchange contributes to the reliability of the detection of the filling level.

The method preferably comprises adjusting the size of the portions of the tissue dispensed by the tissue dispenser; in particular, after a roll exchange of a tissue roll from a first tissue roll position to a second tissue roll position in the tissue dispenser has occurred and/or after a refill of a tissue roll to the first tissue roll position has occurred.

The control unit preferably is adapted to adjust the size of the portions of the tissue dispensed by the dispenser; in particular, after a roll exchange of a tissue roll from a first tissue roll position to a second tissue roll position in the tissue dispenser has occurred and/or after a refill of a tissue roll to the first tissue roll position has occurred.

When a roll exchange of a tissue roll from the first tissue roll position to the second tissue roll position has occurred or has been detected, it is preferred to reduce the tissue size in order to increase the number of portions still available in the dispenser. Once a refill of a tissue roll to the first tissue roll position has occurred or has been detected, the filling level will again be 100%, such that it is preferred to increase the size of the tissue portions in order to provide more comfort to the users.

The size of the portions of the tissue dispensed by the tissue dispenser is preferably adapted from a comfort size to an eco size or vice versa, with the comfort size being larger, in particular, longer, than the eco size.

In particular, it can be preferred that the adjustment of the size of the portions of the tissue dispensed by the tissue dispenser depends on the initial or verified filling level. It is preferred that the size of the portions of the tissue dispensed by the tissue dispenser is adjusted from a comfort size to an eco size when the verified filling level falls below a threshold value.

The method preferably comprises determining a roll exchange of a tissue roll from a first tissue roll position to a second tissue roll position in the tissue dispenser, preferably by receiving a signal from a holding arrangement that the holding arrangement has taken a release position, and/or determining that a new tissue roll has been received in the first tissue roll position, preferably by receiving a signal from a holding that the holding arrangement has taken a hold position; and/or determining that the second tissue roll position is empty, preferably by receiving a signal from a detector for detecting whether the second tissue roll position is empty; and/or determining that a tissue roll is present in the second tissue roll position, preferably by receiving a signal from a detector for detecting that a tissue roll is present in the second tissue roll position.

The control unit is preferably adapted to determine a roll exchange of a tissue roll from a first tissue roll position to a second tissue roll position in the tissue dispenser, preferably by receiving a signal from a holding arrangement that the holding arrangement has taken a release position. The control unit is preferably adapted to determine that a new tissue roll has been received in the first tissue roll position, preferably by receiving a signal from a holding arrangement that the holding arrangement has taken a hold position. The control unit is preferably adapted to determine that the second tissue roll position is empty, preferably by receiving a signal from a detector for detecting whether the second tissue roll position is empty. The control unit is preferably adapted to determine that a tissue roll is present in the second tissue roll position, preferably by receiving a signal from a detector for detecting that a tissue roll is present in the second tissue roll position.

The method preferably comprises determining the filling level depending on presence and/or absence of a tissue roll in the first tissue roll position, and/or presence and/or absence of a tissue roll in the second tissue roll position, and/or a refill of a new tissue roll in the first tissue roll position, and/or roll exchange of a tissue roll from a first tissue roll position to a second tissue roll position.

The control unit preferably is adapted to determine the filling level depending on the presence and/or absence of a tissue roll in the first tissue roll position, and/or the presence and/or absence of a tissue roll in the second tissue roll position, and/or a refill of a new tissue roll in the first tissue roll position, and/or roll exchange of a tissue roll from a first tissue roll position to a second tissue roll position.

The determination of the different events and states relating to the presence/absence of tissue rolls in the first and/or second tissue roll positions and the exchange of tissue rolls or the installation of new tissue rolls further enhances the possibilities to increase reliability and accuracy of the detection of the filling level.

For example, the events and/or states determined can be taken into account when determining a verified filling level and/or verified tissue type information. Further, the determination of information about the states and/or events can be used to adjust the size of the portions of the tissue.

Preferably, the holding arrangement is for holding a tissue roll in the first tissue roll position. Further, preferably, the signal from the holding arrangement that the holding arrangement has taken a release position indicates that the tissue roll in the first tissue roll position has been released. Further, preferably, the signal from the holding arrangement that the holding arrangement has taken a hold position indicates that a tissue roll is present or has been installed in the first tissue roll position.

The method preferably comprises communicating with an external communication unit and/or with a backend unit, preferably in a bidirectional way and/or in a wireless way.

The control unit preferably is adapted to communicate with an external communication unit and/or with a backend unit, preferably in a bidirectional way and/or in a wireless way.

Preferably, communication comprises receiving and/or transmitting data and/or information and/or signals.

Preferably, information about resource usage, in particular, the verified filling level, can be transmitted to the external communication unit and/or to the backend unit. Further, preferably, information, such as software updates and/or settings and/or update of (operational) parameters, can be received from the external communication unit and/or from the backend unit. It is further preferred that the external communication unit and/or the backend unit is adapted and arranged to communicate, preferably in a bidirectional way, with a plurality of arrangements and/or a plurality of dispensers. For example, the wireless communication can be realized by a Bluetooth connection. Further, preferably, the external communication unit and/or the control unit is adapted and arranged to communicate, preferably in a wireless way, such as Bluetooth, to a backend unit, in particular, in order to exchange client specific and/or process related information.

Further, preferably, the control unit and/or the external communication unit and/or the backend unit is adapted and arranged to communicate with one or more mobile devices like tablets or smart phones, preferably, in a bidirectional way and/or in a wireless way.

The method preferably comprises determining and/or saving and/or communicating information regarding one or more of the following and/or the control unit is preferably adapted to determine and/or save and/or communicate information regarding one or more of the following:

- initial filling level,
- verified filling level,
- time stamp,
- initial tissue type information,
- verified tissue type information,
- portion size, in particular currently dispensed portion size and/or comfort portion size and/or eco portion size,
- number of dispensed portions per tissue roll,
- dispensing mode,
- presence and/or absence of a tissue roll in the first tissue roll position,
- presence and/or absence of a tissue roll in the second tissue roll position,
- a refill of a new tissue roll in the first tissue roll position,
- roll exchange of a tissue roll from a first tissue roll position to a second tissue roll position,
- settings for a proximity sensor of the tissue dispenser,
- energy supply level,
- technical status,
- number of dispensed portions without portion removal or portion retraction,
- number of total dispensed portions (over product lifecycle),
- alerts and/or settings for alerts,
- location and/or position and/or group assignment of the tissue dispenser.

In particular, the information mentioned above can be helpful to send from the control unit and/or from the arrangement and/or from the tissue dispenser to an external communication unit and/or a backend unit and/or one or more mobile devices or vice versa. In particular, transmitting such a creation to the control unit enables and facilitates remote maintenance of the tissue dispenser, also referred to as "Over-The-Air" (OTA) maintenance. In particular, when an operator has to manage a large number of tissue dispensers, possibly assigned to groups of several tissue dispensers, it is convenient to be able to provide individual tissue dispensers or groups of tissue dispensers with updates, parameter settings, etc. Further, it is convenient to be able to assign or change location and/or position and/or group assignments of individual or groups of tissue dispensers.

In summary, the ability to remotely communicate with individual tissue dispensers or groups of tissue dispensers, in particular, relating to the information mentioned above, is advantageous in the management of large numbers of tissue dispensers.

Preferably, the dispensing mode is to be understood as an active dispensing mode, in particular, the dispensing mode the dispenser is actively operating in. For example, the dispenser can be operated in different dispensing modes, which preferably differ in one or more operating parameters. For example, dispensing modes can include eco or tissue saving mode and/or comfort mode and/or display mode and/or hygiene mode. For example, in eco mode, the size of the portions of the tissue dispensed by the tissue dispenser is set to a reduced eco size, and/or in comfort mode, the size of the portions of the tissue dispensed by the tissue dispenser is set to an enlarged comfort size. For example, in display mode, after a portion of the tissue has been dispensed by the tissue dispenser and has been removed by the user, a new portion of tissue is forwarded by the output mechanism in order to be ready for removal by the next user (i.e., there is a new tissue portion "on display"). For example, in hygiene mode, after a portion of the tissue has been dispensed by the tissue dispenser and has been removed by the user, no new portion of tissue is forwarded by the output mechanism, such that a user will always receive a tissue portion which has been kept within the hygienic environment of the interior of the dispenser just until prior to dispensing it for the removal of the user.

In particular, it is preferred that the control unit is adapted to change an operation mode of the dispenser, in particular, of the output mechanism depending on whether the holding mechanism is in the release position or in the hold position and/or depending on whether the output mechanism supplies portions of tissue from a tissue roll in the first tissue roll position or in the second tissue roll position. Preferably, the operation mode of the dispenser is changed from a comfort mode to an eco or tissue saving mode when the holding mechanism is in the release position and/or when the output mechanism supplies portions of tissue from a tissue roll in the second tissue roll position. Further, preferably, the operation mode of the dispenser is changed back from the eco mode to the comfort mode when the holding mechanism is in the hold position and/or when the output mechanism supplies portions of tissue from a tissue roll in the first tissue roll position. Preferably, a tissue portion in the eco mode is shorter than a tissue portion in the comfort mode. Further, preferably, the control unit is adapted to operate the output mechanism for a shorter period of time per dispensing action in the eco mode than in the comfort mode. A shorter operation of the output mechanism preferably leads to a shorter tissue portion. In this way, by providing for a tissue saving mode, the remaining tissue on the tissue roll in the second tissue roll position can last longer, in particular, until a new tissue roll is inserted into the first tissue roll position.

BRIEF DESCRIPTION OF THE DRAWINGS

Preferred embodiments shall now be described with reference to the attached drawings, in which.

DETAILED DESCRIPTION OF THE EMBODIMENTS

Figure 1:
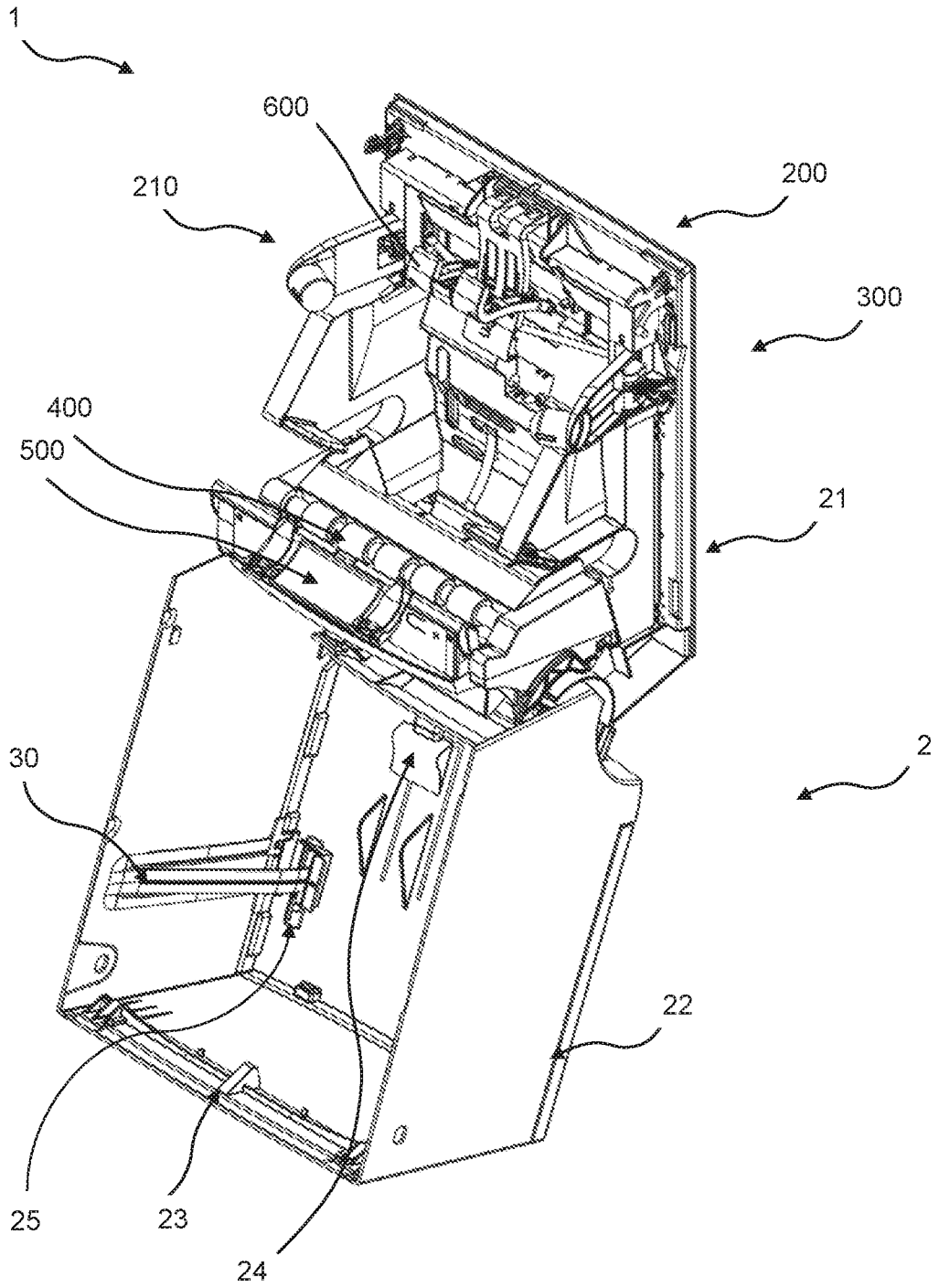
FIG. 1 shows a three-dimensional front view of an exemplary embodiment of a dispenser with an open housing cover and with a holding arrangement in the release position.
Figure 2:
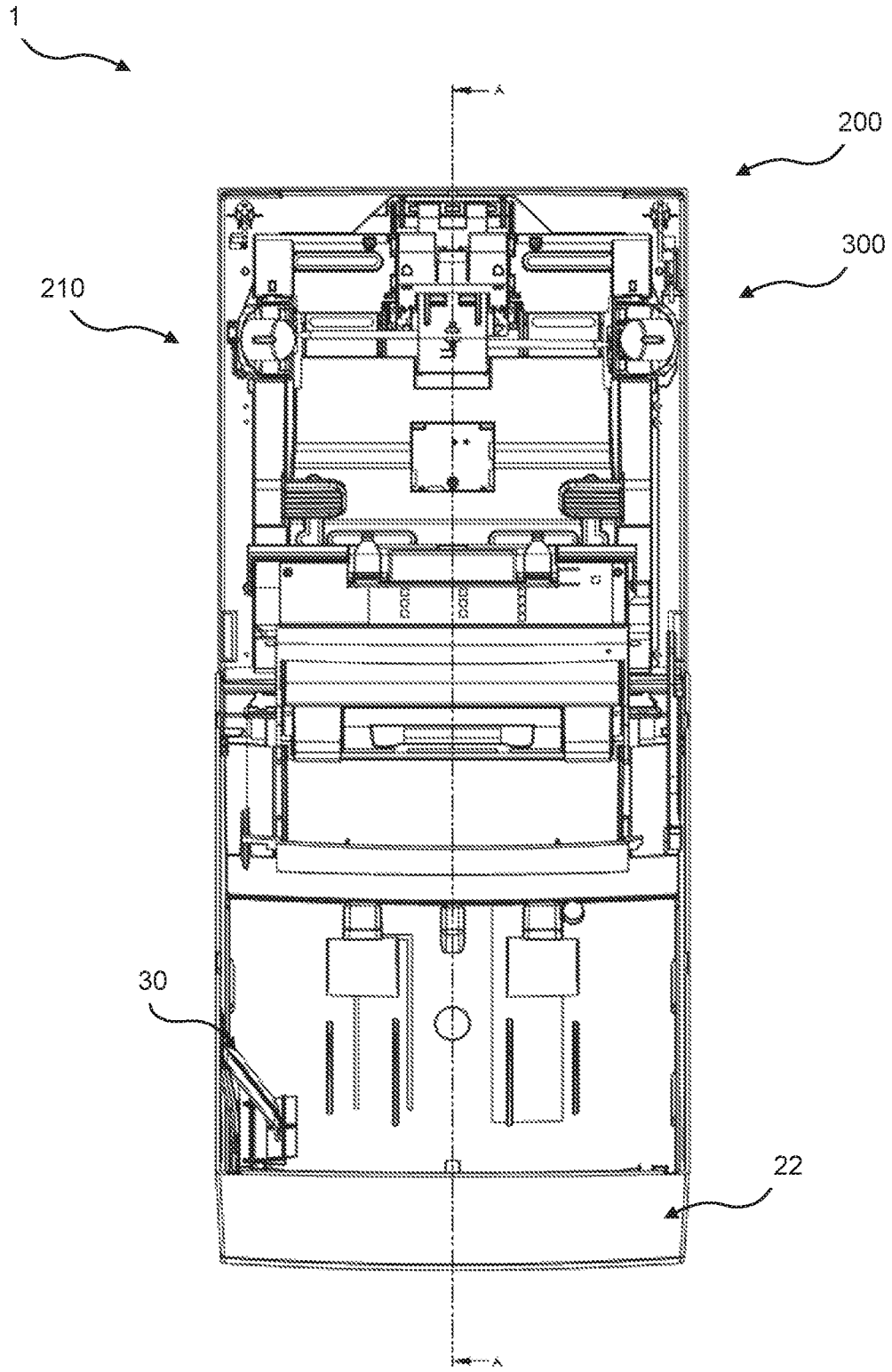
FIG. 2 shows a front view of the dispenser according to FIG. 1.

In the Figures, elements with the same or comparable functions are indicated with the same reference numerals.

In the Figures, a dispenser 1 is shown with a housing 2 comprising a housing base 21 for wall mounting the dispenser 1 and an openable housing cover 22. The housing cover 22 is connected pivotably to the housing base 21. FIGS. 1 to 6 show the housing cover 22 in its open position.

As can be seen in FIG. 1, for example, on the inner upper side of the housing cover 22 a first protrusion 23 is provided and on the lower inner side of the housing cover 22 a second protrusion 24 is provided. The function of these two protrusions 23, 24 will be explained in detail below. Further, on the inside of one of the sidewalls of the housing cover 22 a level indicator 30 is provided. The level indicator 30 will also be described in further detail below. Further, on the front side of the housing cover 22 an indicator opening 25 is provided, through which an indication surface 33 of a level indicator 30 can be seen, as will be described further below. As can be seen from FIG. 21, the indicator opening 25 is covered by a cover glass 26. Optionally, a front panel 27 can be provided on the housing cover 22.

The dispenser 1 further comprises a holding arrangement 200 with a holding mechanism 210, a shift mechanism 300, and an output mechanism 400, a transfer mechanism 500, and a diameter sensor 600, which will be discussed in more detail below.

Figure 21:
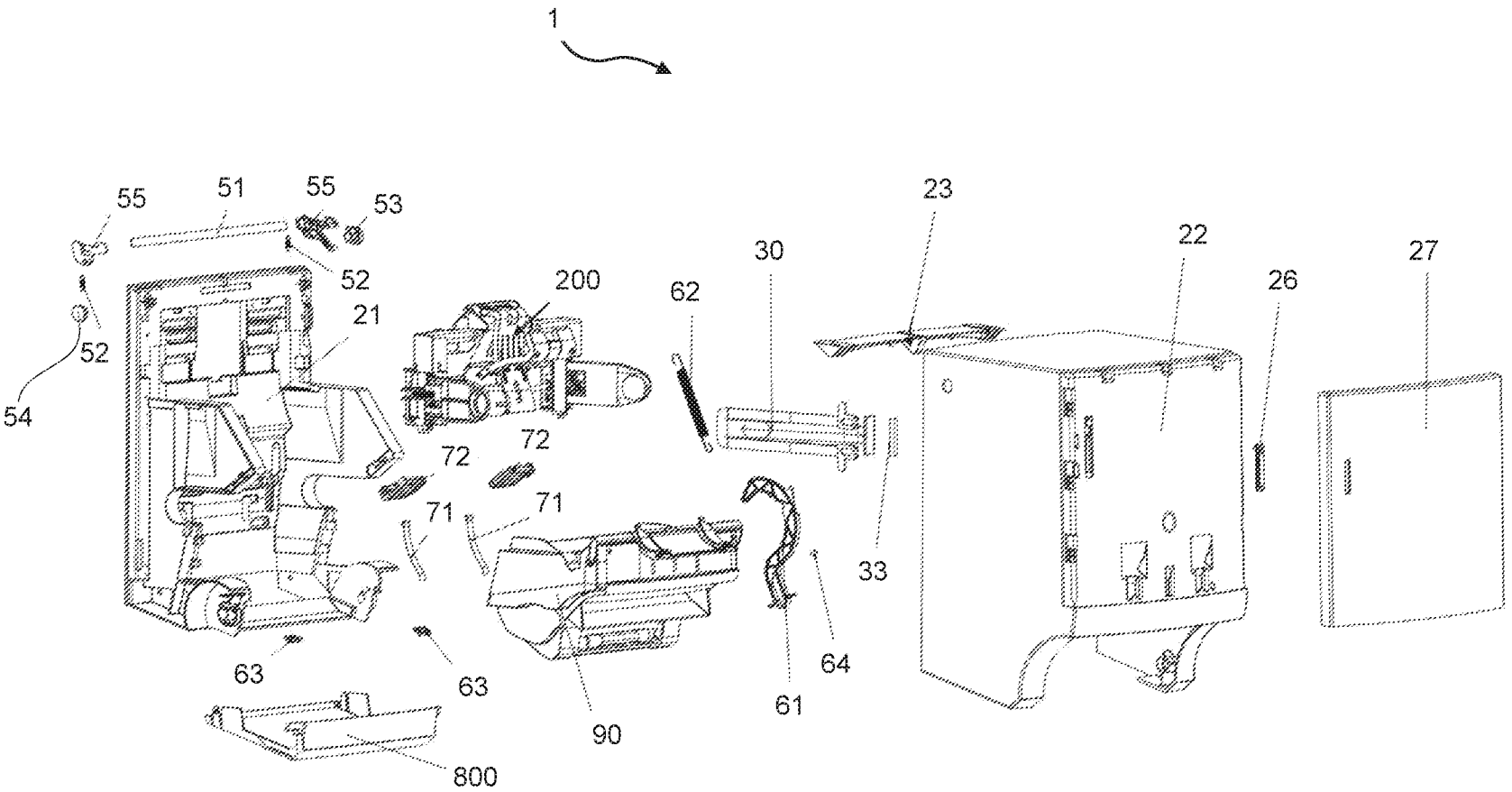
FIG. 21 shows an exploded view of an embodiment of a dispenser.

As can be seen from FIG. 21, the housing cover 22 is pivotably mounted to the housing base 21 via a bracket 61, housing spring 62, and cover magnet 64, and secured against unintentional release via safety catches 63. The housing cover 22 can be locked to the housing base 21 via a closure mechanism (cf. FIG. 21), which can be operated via a key by service personnel. The closure mechanism comprises a flat steel 51, lock springs 52, lock catches 55, a lock lever 53, and a lock plug 54.

Figure 18:
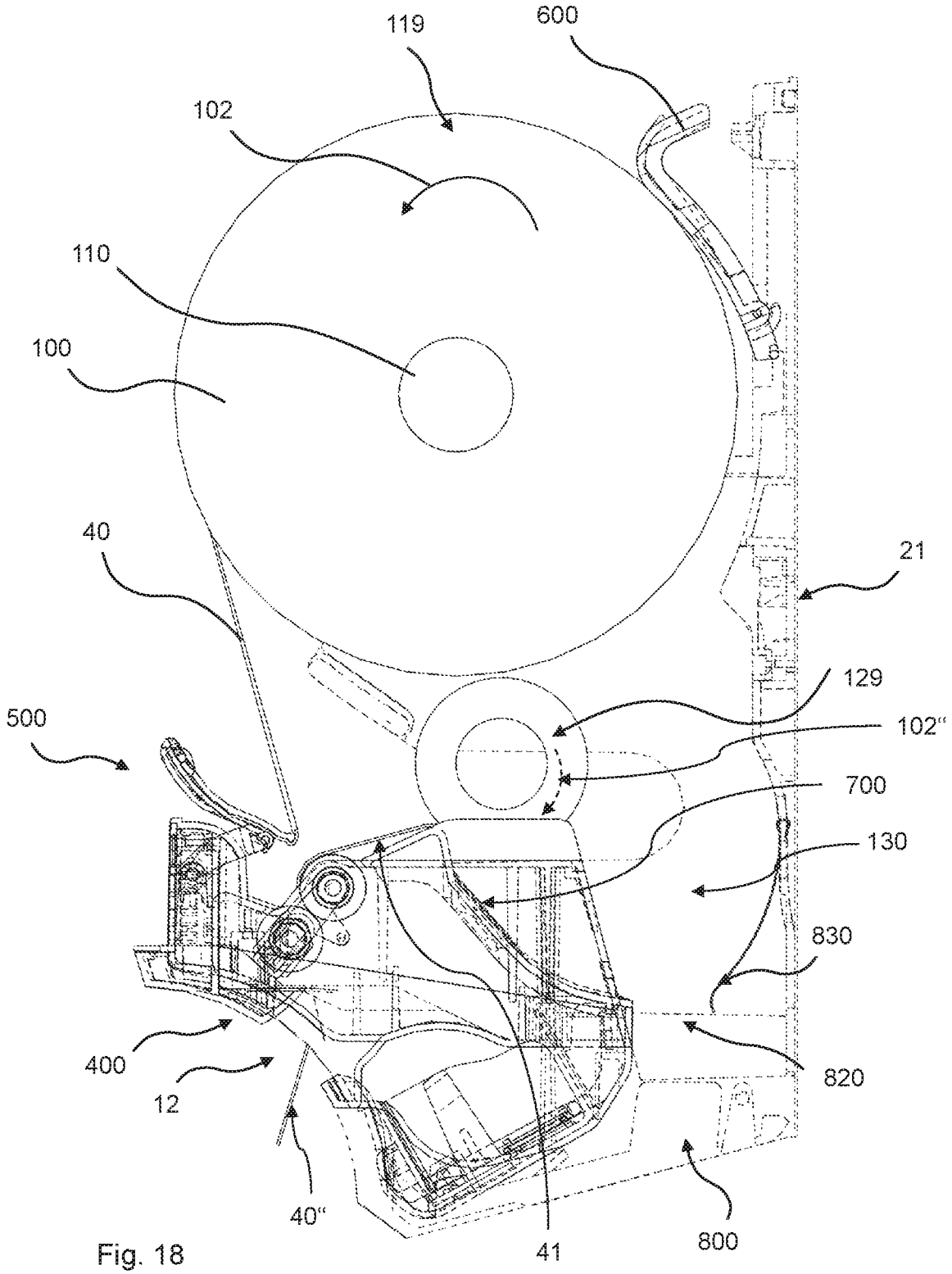
FIG. 18 shows a partial section of the dispenser according to FIG. 1 with a full tissue roll and a reduced diameter tissue roll.

As can be seen in FIG. 18, for example, the dispenser 1 has a first tissue roll position 119 with a refill tissue roll with a continuous web of tissue 40 and a second tissue roll position 129 with a spare tissue roll with a further continuous web of tissue 40". The tissue roll 100 in FIG. 18 has a counterclockwise direction of unrolling 102 and the tissue roll in the second tissue roll position 129 has a clockwise direction of unrolling 102".

Figure 3:
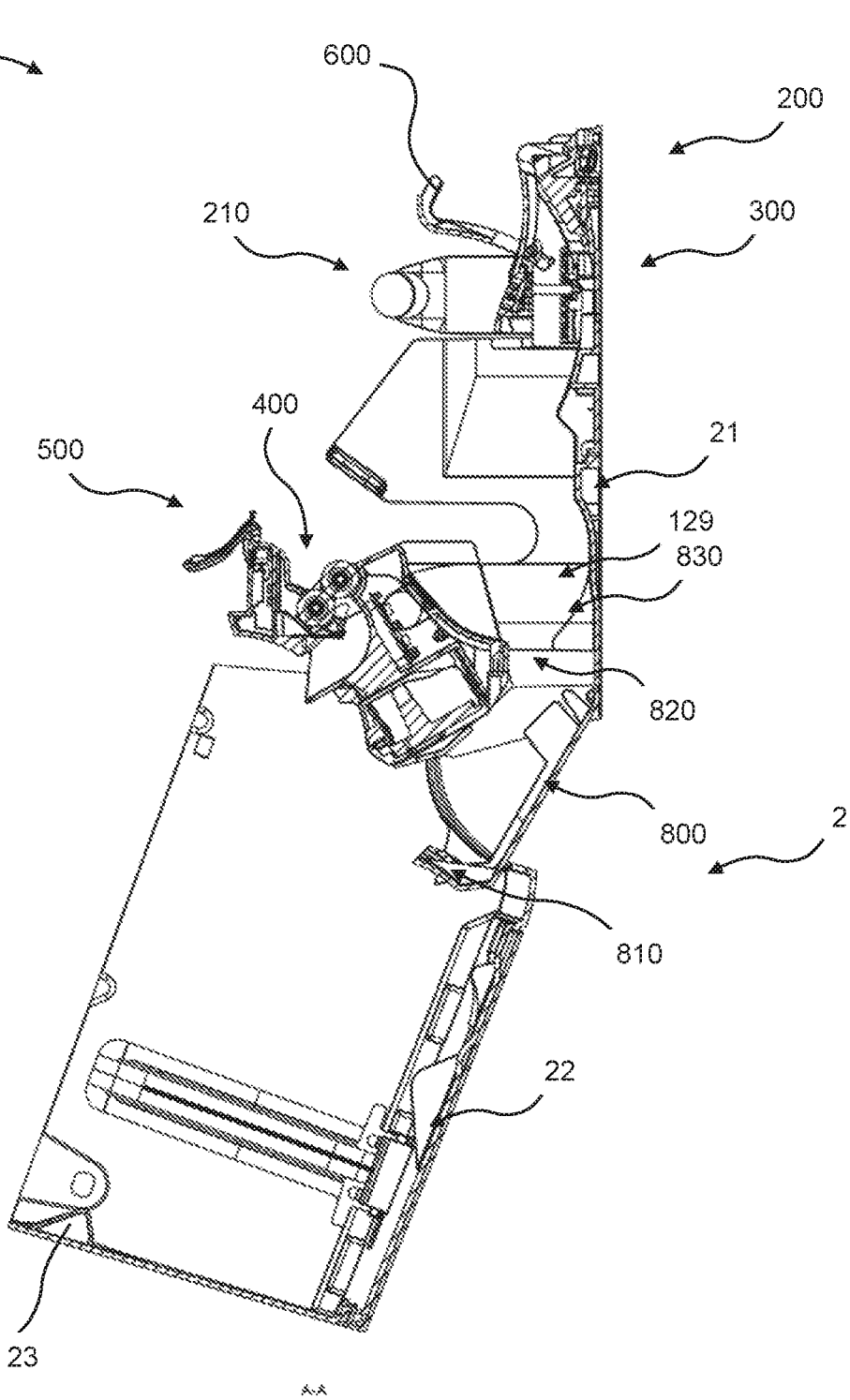
FIG. 3 shows a section along A-A as indicated in FIG. 2.
Figure 4:
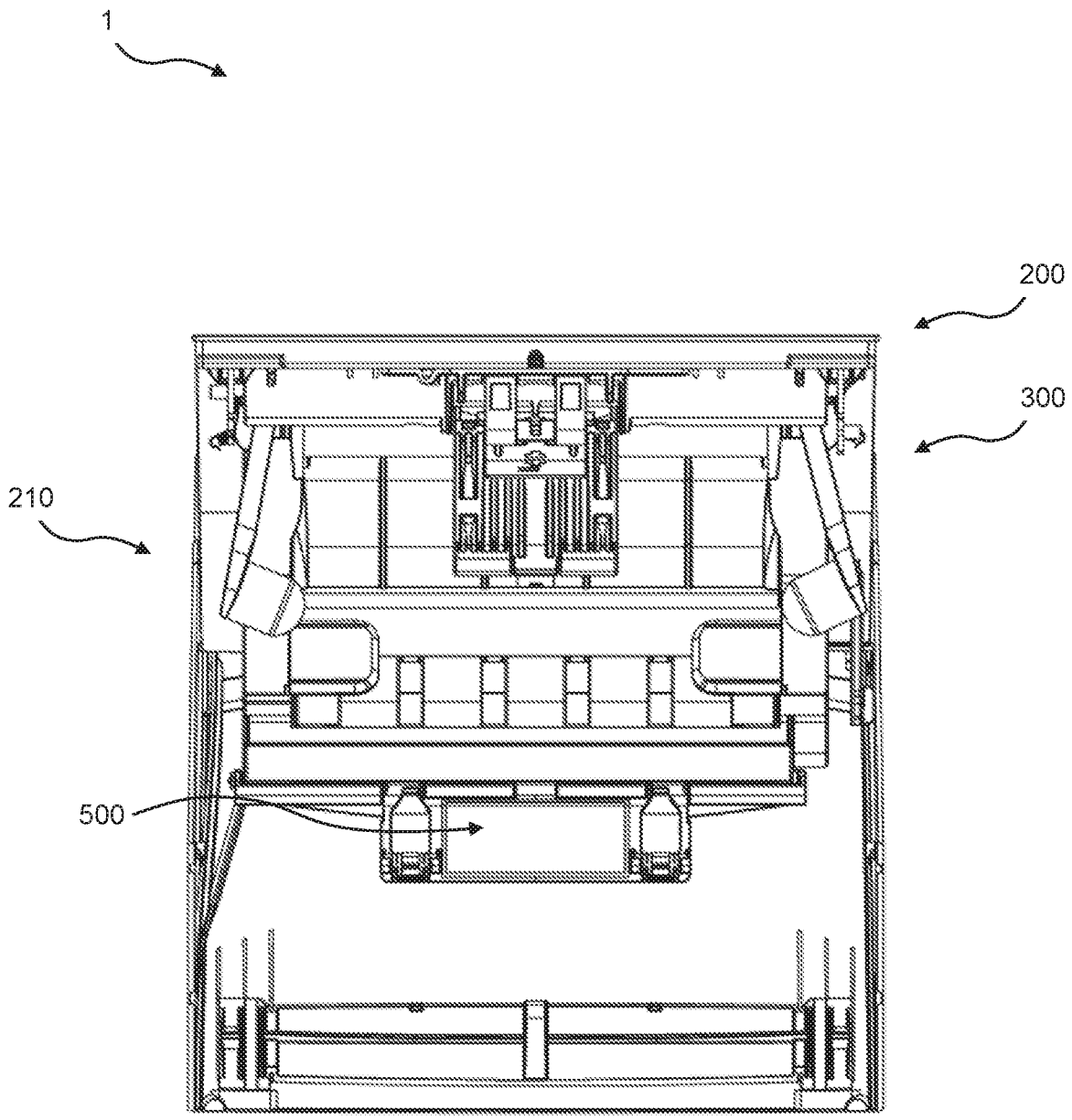
FIG. 4 shows a top view of the dispenser according to FIG. 1.
Figure 5:
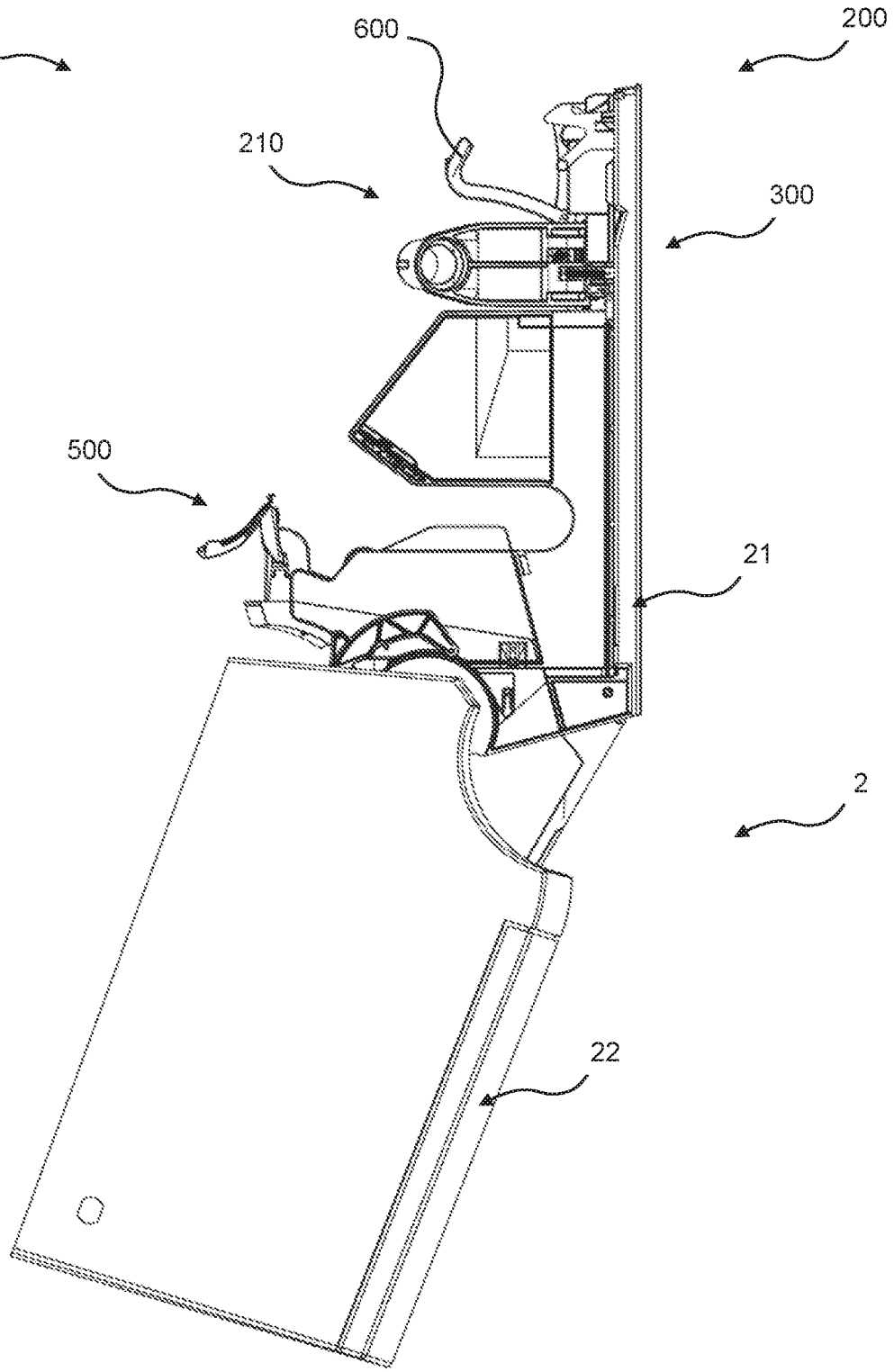
FIG. 5 shows a side view of the dispenser according to FIG. 1.
Figure 6:
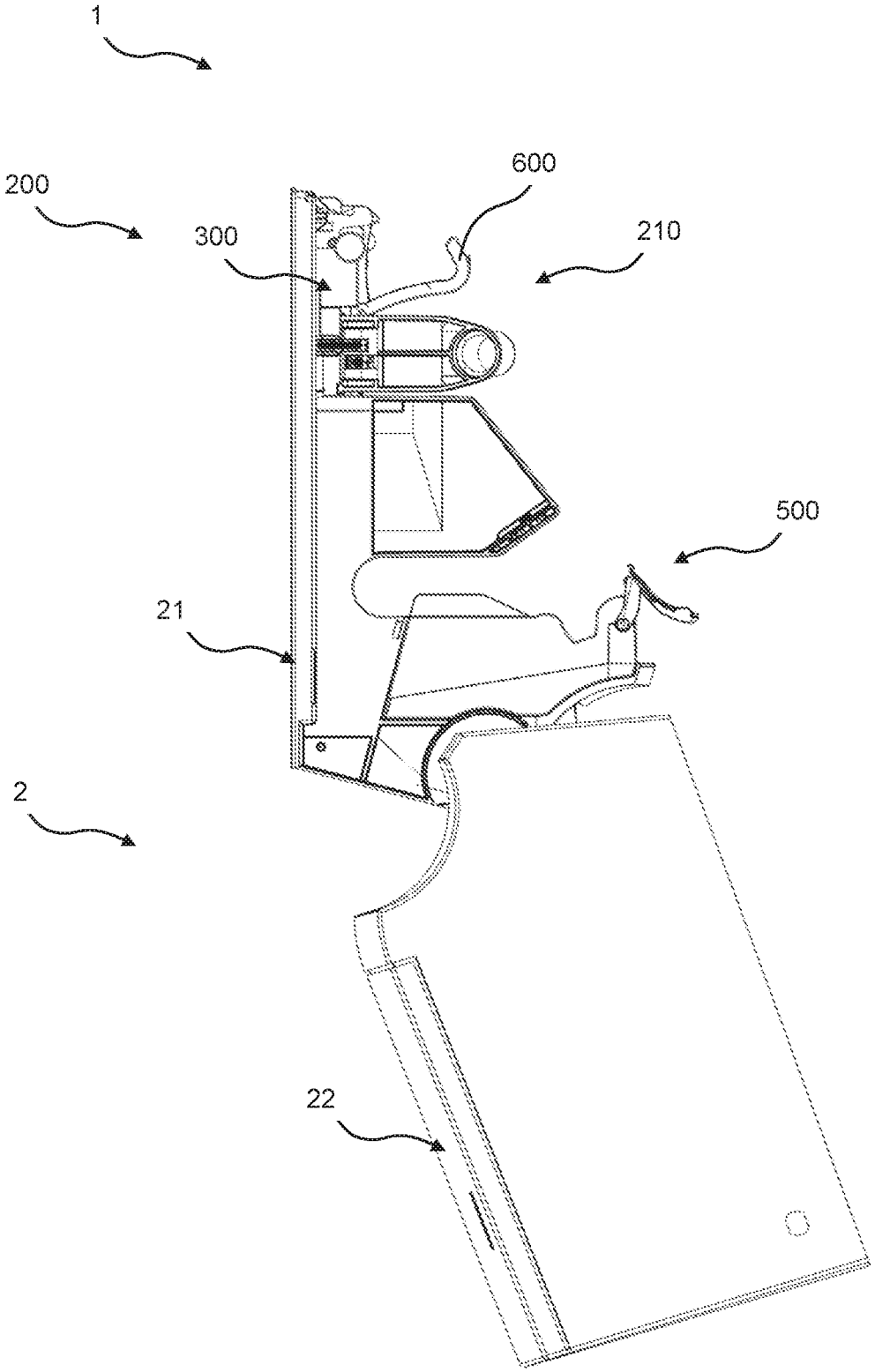
FIG. 6 shows a further side view of the dispenser according to FIG. 1.
Figure 20:
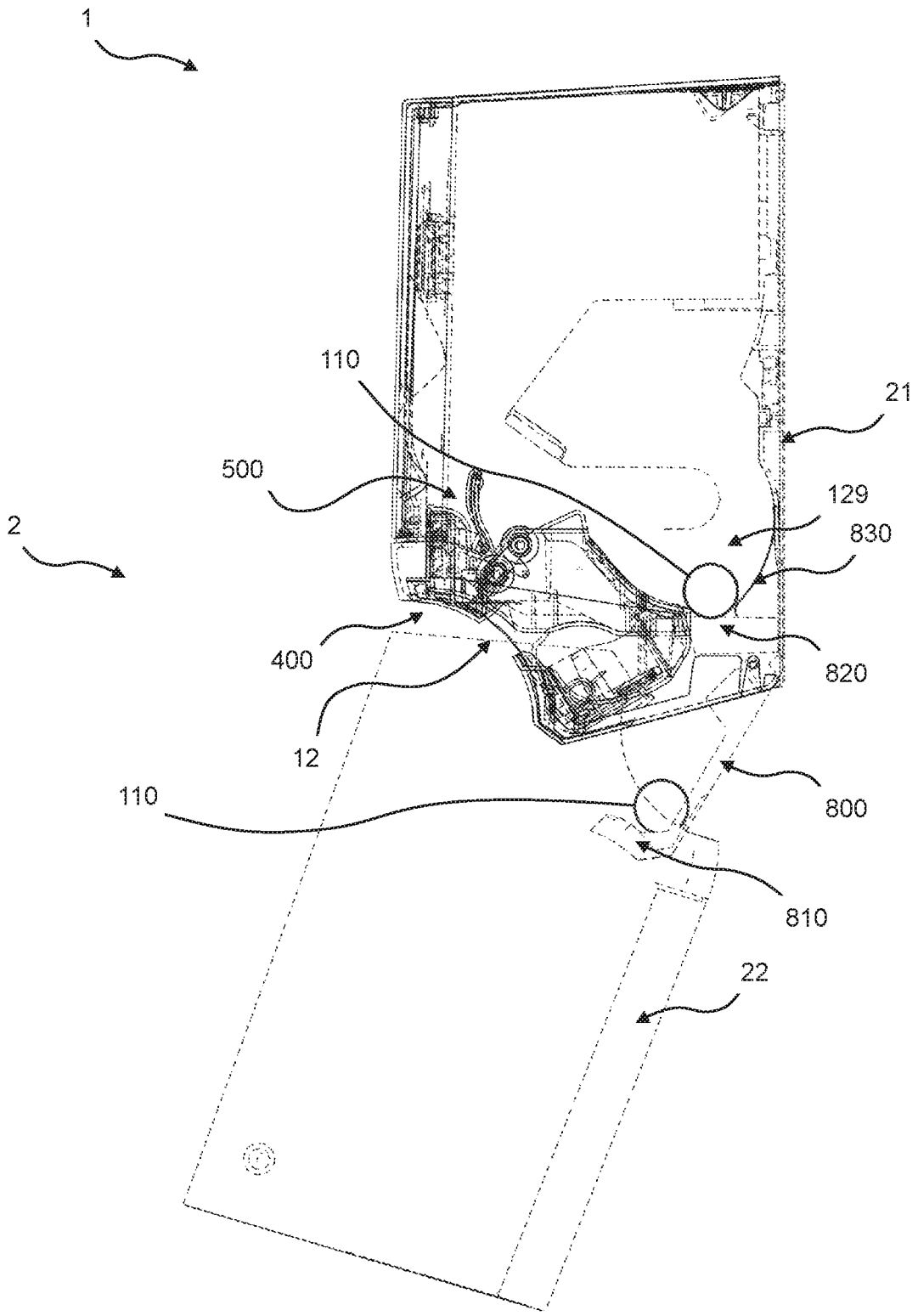
FIG. 20 shows a partial section of the dispenser according to FIG. 1 with the housing in the closed and in the open position and an empty tissue roll in different positions.

At the lower end of the second tissue roll position 129, an axle opening 820 is provided through which an empty axle of the tissue roll can pass to enter a tissue roll axle receptacle 800, as can be seen in FIGS. 3 and 20, for example. The axle opening 820 has a stop element 830, which is an elastic element. The stop element 830 stops the empty axle of the tissue roll from passing the axle opening 820 only by the force of gravity. Rather, when a tissue roll is being released from the first tissue roll position 119 and falls down to the second tissue roll position 129, a downward directed force is exerted on to the empty axle 110 of the tissue roll, which then can temporarily move the stop element 830 and pass the axle opening 820 to enter the tissue roll axle receptacle 800. The tissue roll axle receptacle 800 has a retention element 810 retaining the axle 110 of the tissue roll when the tissue roll axle receptacle 800 is open, as can be seen in FIG. 20. Preferably, the tissue roll axle receptacle 800 is in its open position (shown in broken lines in FIG. 20), when the housing cover 22 is in its open position (shown in FIG. 20 also in broken lines).

Figure 7:
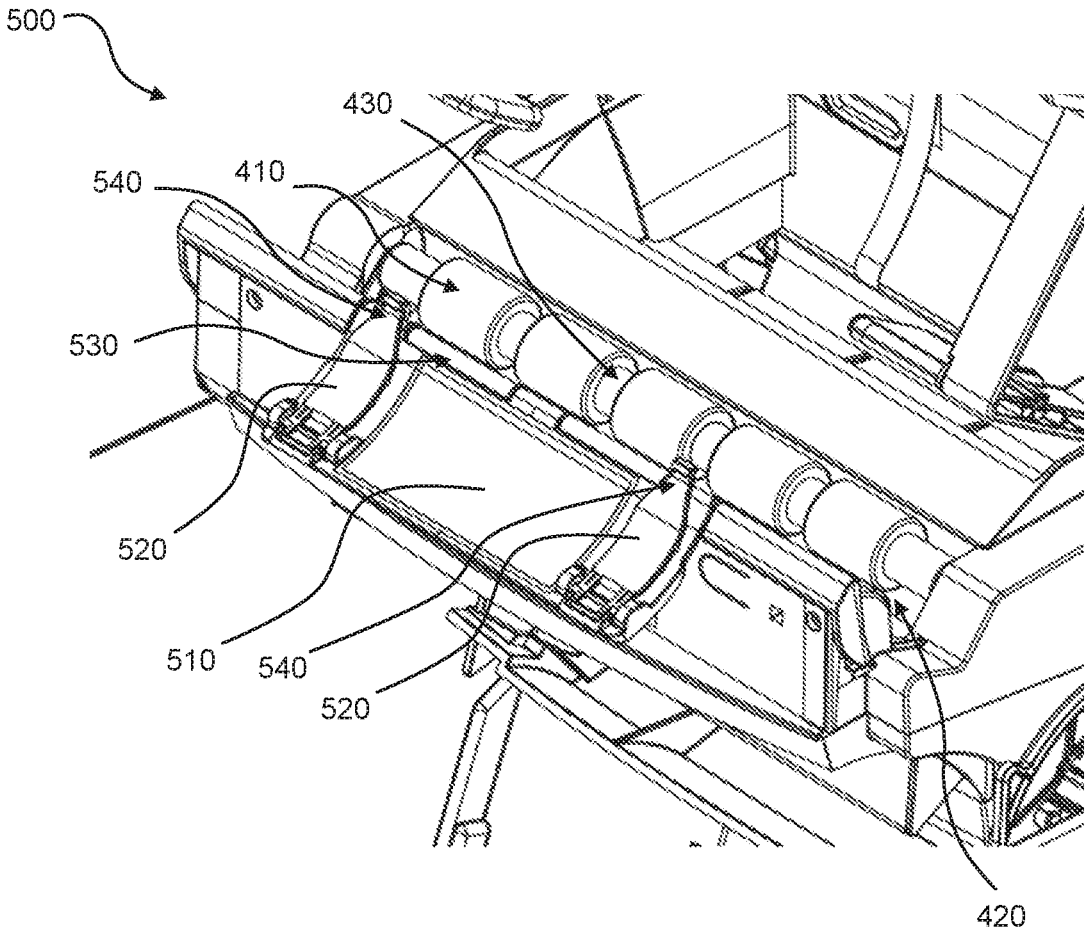
FIG. 7 shows an enlarged detail of the dispenser according to FIG. 1.
Figure 8:
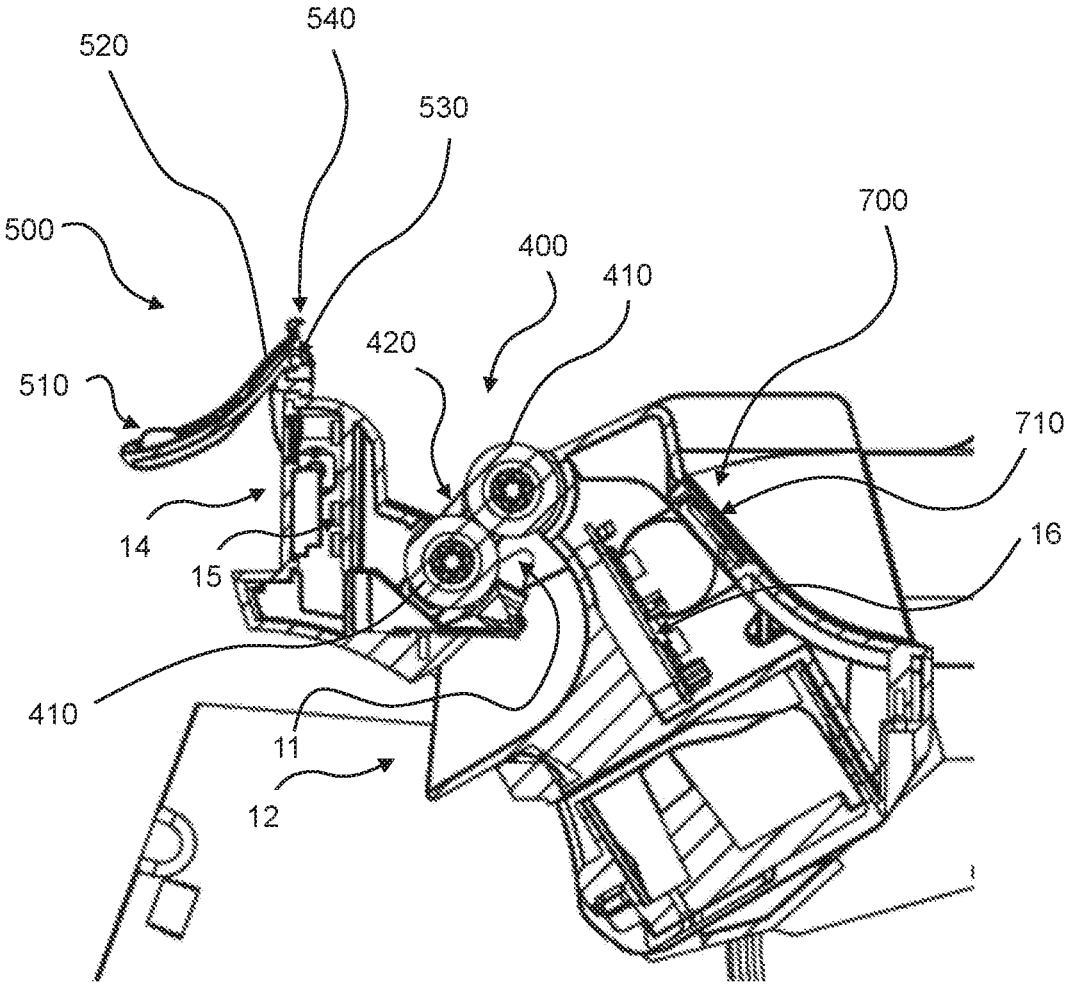
FIG. 8 shows an enlarged detail of the dispenser according to FIG. 3.
Figure 19:
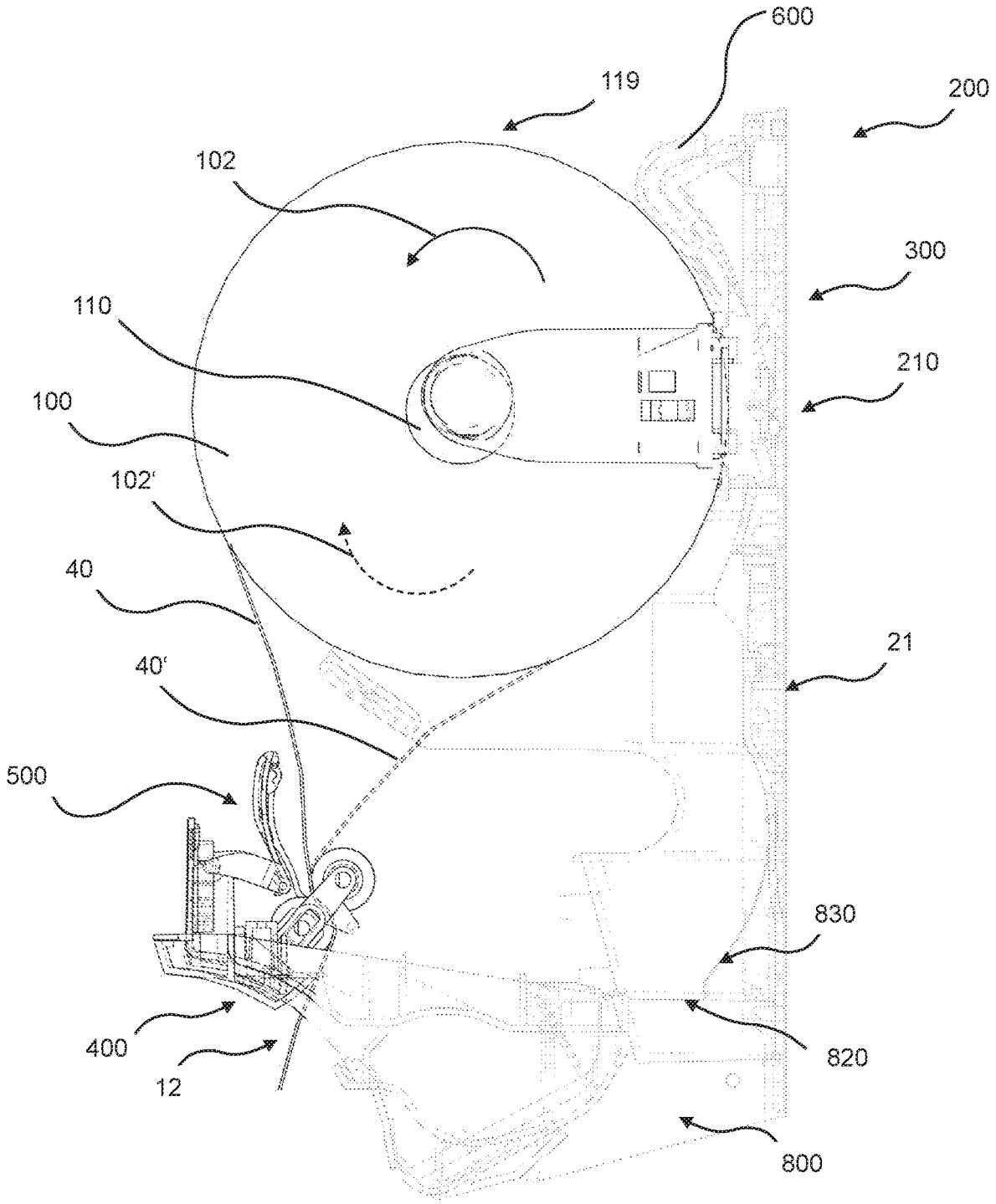
FIG. 19 shows a partial section of the dispenser according to FIG. 1 with a full tissue roll and two different directions of unrolling the tissue roll.
Figure 23:
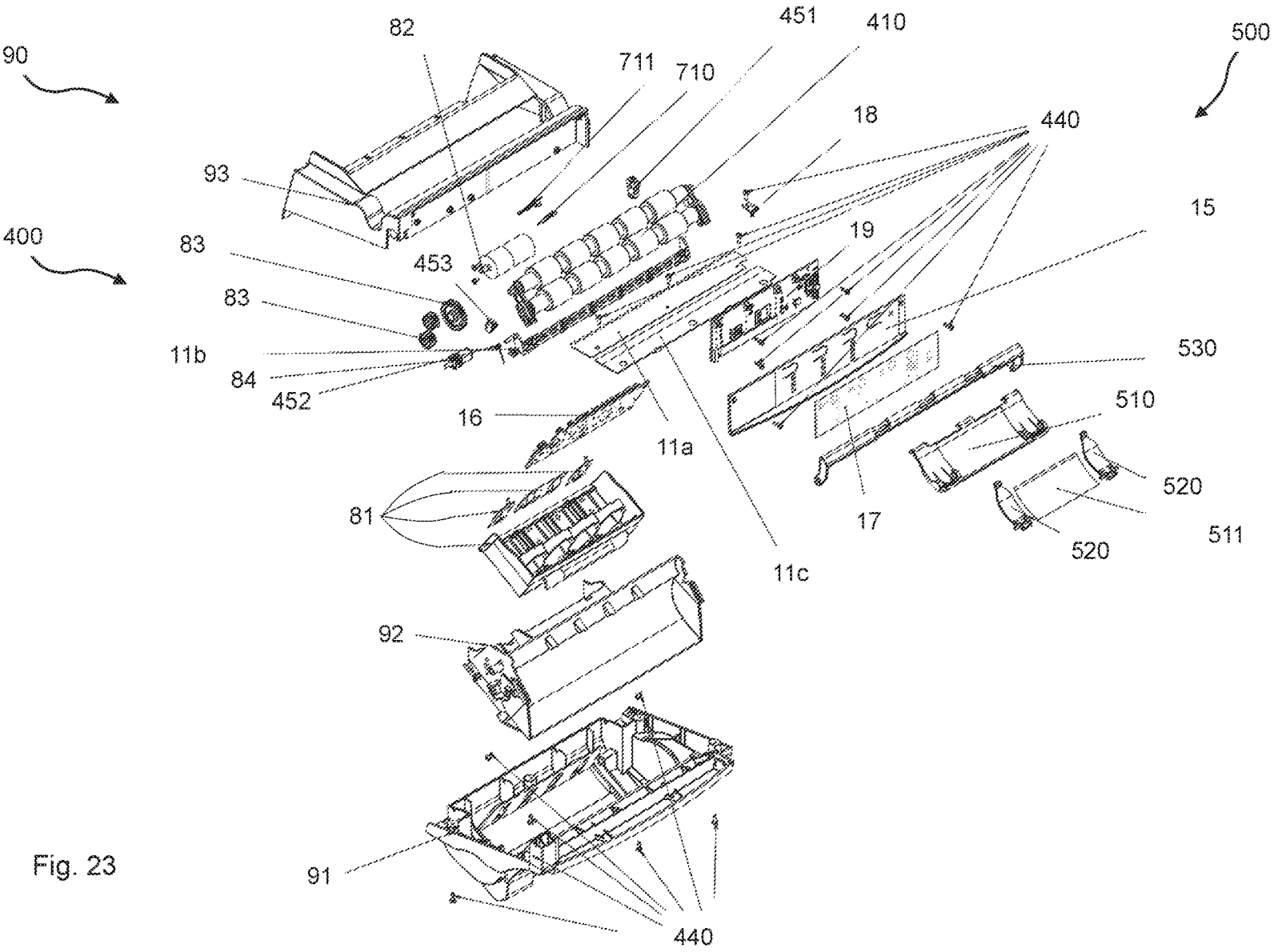
FIG. 23 shows an exploded view of an embodiment of a dispenser module.

In FIGS. 7 and 8 as well as in FIGS. 18, 19, and 23, a dispenser module 90 and the output mechanism 400 and the transfer mechanism 500 are shown in more detail. The dispenser module 90 preferably comprises a module body 91, a module center 92, and a module cover 93. The elements of a dispenser module 90 can be connected by screws 440, for example.

As can be seen in FIG. 8, for example, the output mechanism 400 for supplying portions of tissue from a tissue roll in the first or second tissue roll position to a dispensing opening 12 comprises two output rollers 410. A continuous web of tissue can be supplied to the dispensing opening 12 by a rotation of the output rollers 410 through an output gap 420 between the output rollers 410. The output mechanism 400 is suitable for supplying portions of tissue from a continuous web tissue regardless of whether the tissue roll is in the first tissue roll position 119 or in the second tissue roll position 129 (cf. FIG. 18). As depicted in FIG. 23, the output mechanism 400 and/or the transfer mechanism 500 and/or the dispenser module 90 can comprise a battery module 81, a drive unit 82 with a gear transmission 83, and a holder 84 for driving the output rollers 410.

In FIG. 18, a tissue roll with a reduced diameter is present in the second tissue roll position 129 and tissue 40" is supplied by the output mechanism 400 to the dispensing opening 12. As can be seen, for example, in FIG. 18, a tissue roll can be held in the second tissue roll position 129 by a trough-like receiving section 130 in a lower portion of the dispenser 1. When the spare tissue roll with a very reduced diameter as shown in FIG. 18 has a tissue 40" connection to the output mechanism 400, the tissue roll can be at an upper portion of the trough-like receiving section 130 in the second tissue roll position 129. In case the spare tissue roll still has a slightly larger diameter than shown in FIG. 18, this spare tissue roll is heavier and can thus be positioned in a lower portion of the trough-like receiving section 130 for the second tissue roll position. When the spare tissue roll is completely empty and only the axle remains, the axle 110 moves, usually by gravity, to the lower part of the trough-like receiving section 130, where the tissue roll axle opening 820 is located, as can be seen from FIG. 20.

As can be seen in FIG. 18, the transfer mechanism 500 holds an end of a tissue roll 100 in the first tissue roll position 119. As can be seen in FIG. 19, the transfer mechanism 500 is adapted to hold and transfer an end of a tissue roll in the first tissue roll position 119 independent from its unrolling direction, which can be counterclockwise 102 or clockwise 102' (broken lines). The transfer mechanism 500 is shown in its service position in FIG. 18 and in its handover position in FIG. 19.

Further, FIGS. 7 and 8 also show the transfer mechanism 500 in its service position. The transfer mechanism 500 is adapted for releasably holding and transferring an end of tissue 40, 40' from a tissue roll 100 in the first tissue roll position 119 to the output mechanism 400. The transfer mechanism 500 comprises a transfer plate 510 and two retainer flaps 520. The retainer flaps 520 are mounted on the transfer plate 510. The transfer plate 510 is pivotally connected to a transfer rod 530, which is movable to bring the transfer mechanism 500 from the service position into the handover position. Transfer rod 530 is driven by drive 452. Each of the retainer flaps 520 comprises a transfer projection 540. Between the retainer flaps 520 a middle flap 511 (cf. FIG. 23) can be provided.

At least one of the rollers 410 of the output mechanism 400 comprises several axially spaced recesses 430 in the form of a reduced diameter of the output roller 410. The transfer projections 540 of the retainer flaps 520 are adapted to project into the recesses 430 of the output roller 410 in order to transfer the end of the tissue into the gap 420 between the output rollers 410 in the handover position, as can be seen, for example, from FIG. 19.

The end of the tissue roll in the first tissue roll position 119 can be inserted into the transfer mechanism 500 by inserting the end of the tissue roll between the retainer flaps 520 and the transfer plate 510. The end of a tissue roll can be biased in between. In the service position, the transfer plate 510 projects from the transfer rod 530 in direction toward a user when the housing is open. This facilitates the insertion of an end of the tissue roll into the transfer mechanism 500, in particular, between the retainer flaps 520 and the transfer plate 510, by a user. When the housing cover is closed, preferably the second projection 24 on the lower inner side of the housing cover 22 contacts the transfer plate 510 and slightly lifts the transfer plate 510 from its service position, shown in FIG. 8, into a slightly higher position, shown in FIG. 18. From the position shown in FIG. 18, the transfer mechanism 500 can move into the handover position shown in FIG. 19, in which the transfer projections 540 project into the recesses of the output roller 410. Once the end of the tissue roll is inserted into the gap 420 between the upper rollers 410, and, in particular, when the output rollers 410 start rotating in order to supply tissue, the end of the tissue roll is released from in between the retainer flaps 520 and the transfer plate 510.

As can be seen, in particular, in FIGS. 8 and 18, a detector 700 detecting whether the second tissue position is empty is provided. In the example depicted, the detector 700 is in the form of an optical tissue sensor 710 for detecting the presence of a tissue connection between the second tissue roll position and the output mechanism 400. The optical tissue sensor 710 is covered with an infrared glass 711.

This optical sensor 710 detects whether a tissue connection 41 is present between a tissue roll in the second tissue roll position 129 and the output mechanism 400. In case such a tissue connection 41 is present, as shown in FIG. 18, the transfer mechanism 500 remains in the elevated service position as shown in FIG. 18, releasably holding the end of the tissue roll 100 in the first tissue roll position 119. Preferably, the transfer mechanism 500 is activated only when the detector 700 in the form of optical tissue sensor 710 detects that no tissue connection is present between the tissue roll in the second tissue roll position 129 and the output mechanism 400.

Preferably, a cutting unit 11 (cf. FIG. 8) is provided between the dispensing opening 12 and the output rollers 410 for cutting off portions of tissue from the continuous web of tissue. As can be seen in detail in FIG. 23, a cutting unit preferably comprises a blade 11*a*, a blade shield 11*b*, and a blade cover 11*c*. A blade switch 453 is provided for detecting whether the blade 11*a* has been activated, which indicates that a user has taken a portion of tissue from the dispenser.

Further preferably, a control unit 16 (cf. FIGS. 8, 23) is provided for performing various control functions to realize the various features described herein. The control unit 16 preferably comprises a microcontroller and further preferably performs all control functions necessary to operate the dispenser 1.

A user interface 15 with a user interface unit 19 and user interface sticker 17 provides information to a user. The status LED 18 can indicate a fault status, for example, to a user. Preferably, the user interface unit 19 does not comprise a microcontroller.

Further, preferably, the output mechanism 400 is an automatic output mechanism 400 which is activated by a signal from a proximity sensor 14 for detecting the presence of a user. A dispenser 1 with such a functionality can also be described as a non-touch dispenser.

Figure 9:
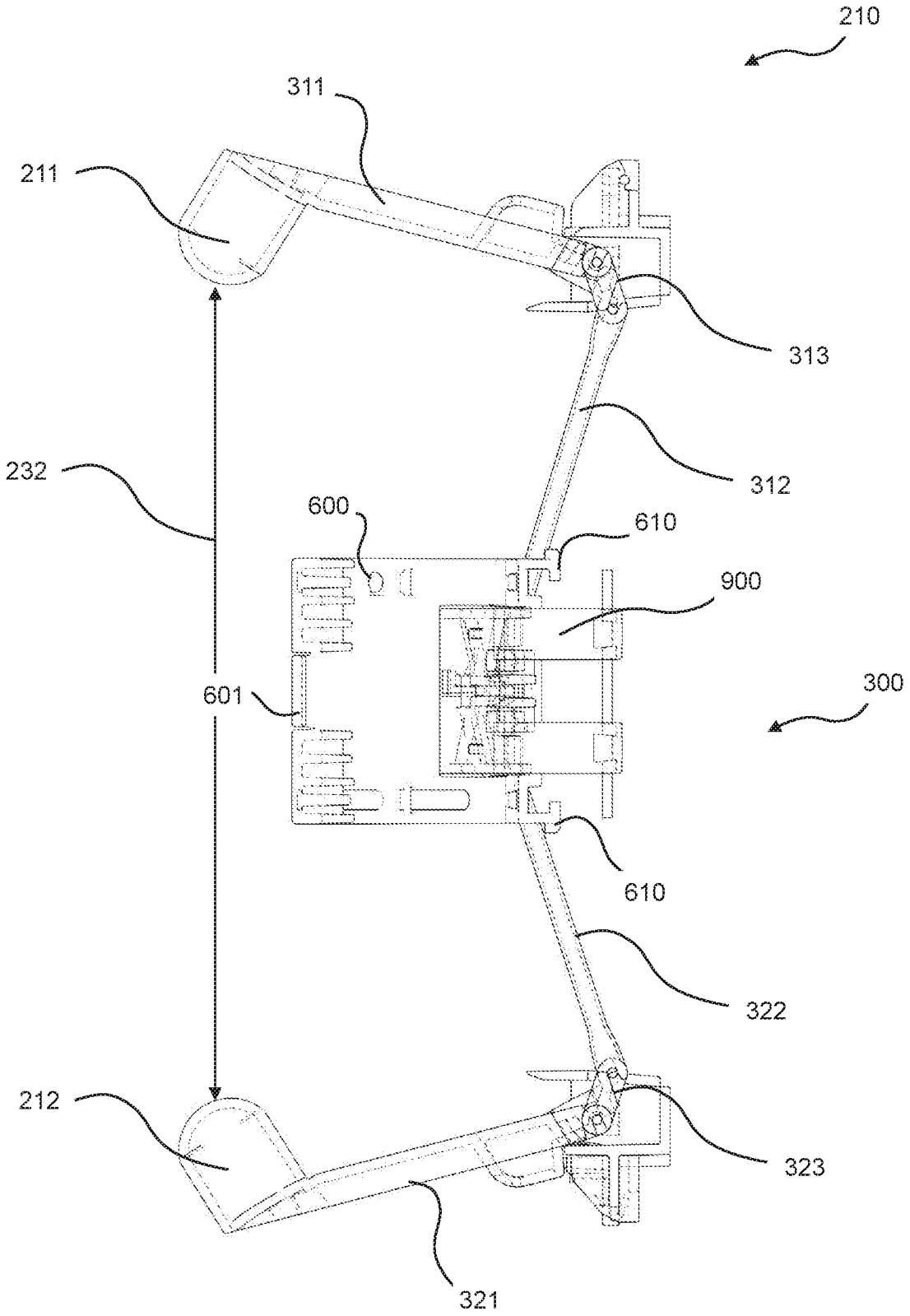
FIG. 9 shows a top view of an exemplary embodiment of a holding arrangement in the release position.
Figure 10:
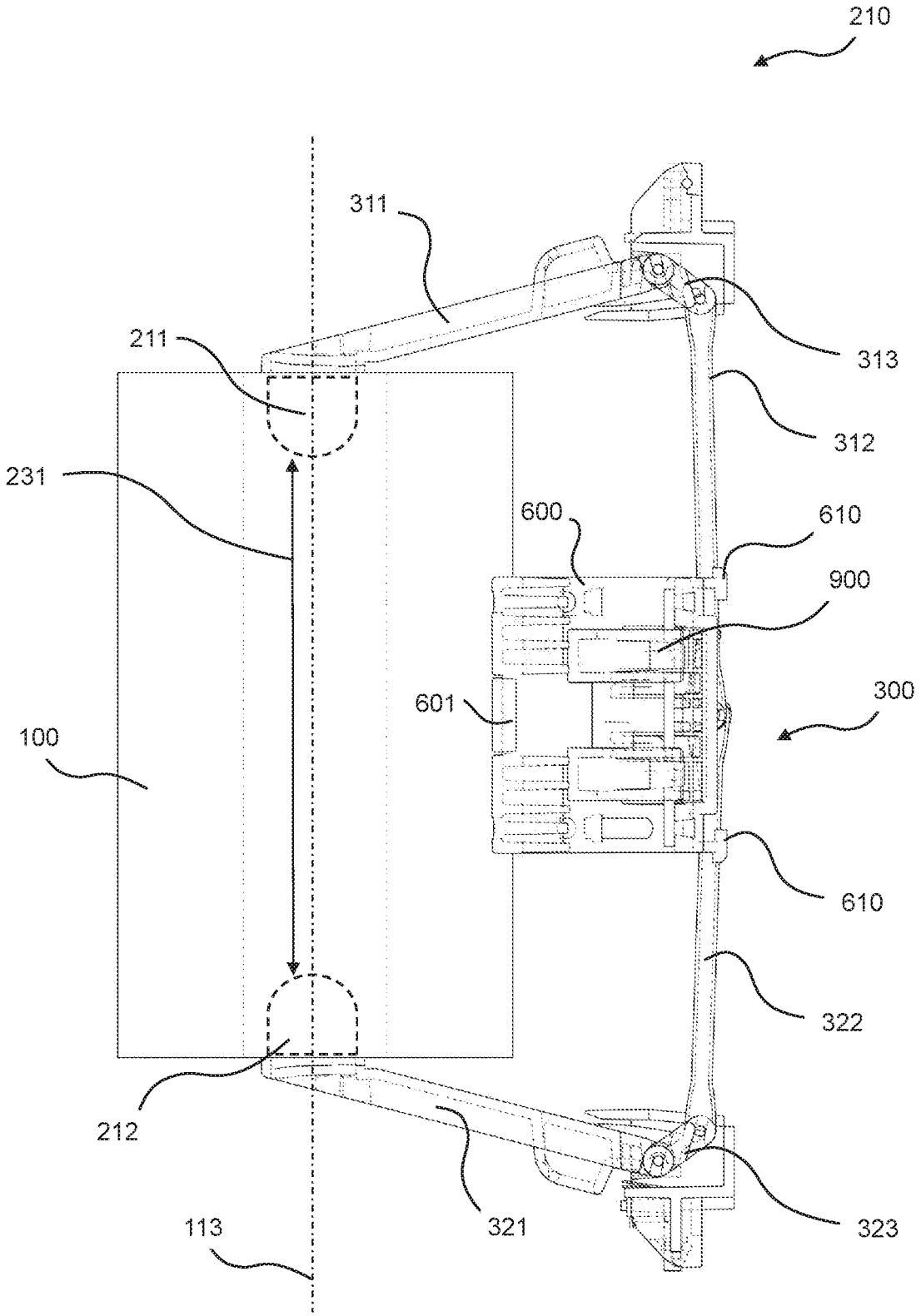
FIG. 10 shows a top view of the holding arrangement in the hold position.

The dispenser 1 further features a holding arrangement 200 with a holding mechanism 210 comprising a first holding element 211 for engaging a first end of an axle 110 of the tissue roll 100 and a second holding element 212 for engaging a second end of an axle 110 of the tissue roll 100. The holding mechanism 210 is shown in more detail in FIGS. 9 and 10. As can be seen from these Figures in particular, a horizontal distance 232 in an axial direction of the tissue roll axis 113 between the first holding element 211 and the second holding element 212 in the release position is larger than a horizontal distance 231 in an axial direction of the tissue roll axis 113 in the hold position. In addition, these Figures show that the first and second holding elements 211, 212 are spaced from the axle 110 of the tissue roll 100 in the release position. In the hold position, however, the holding mechanism 210, in particular, the first and second holding arms 311, 321 and the first and second holding elements 211, 212 provide full operative support for the tissue roll 100 in the first tissue roll position 119 during operation of the dispenser and, in particular, during supply of tissue from the tissue roll by unrolling the tissue roll in an unrolling direction about the tissue roll axis 113.

Figure 11:
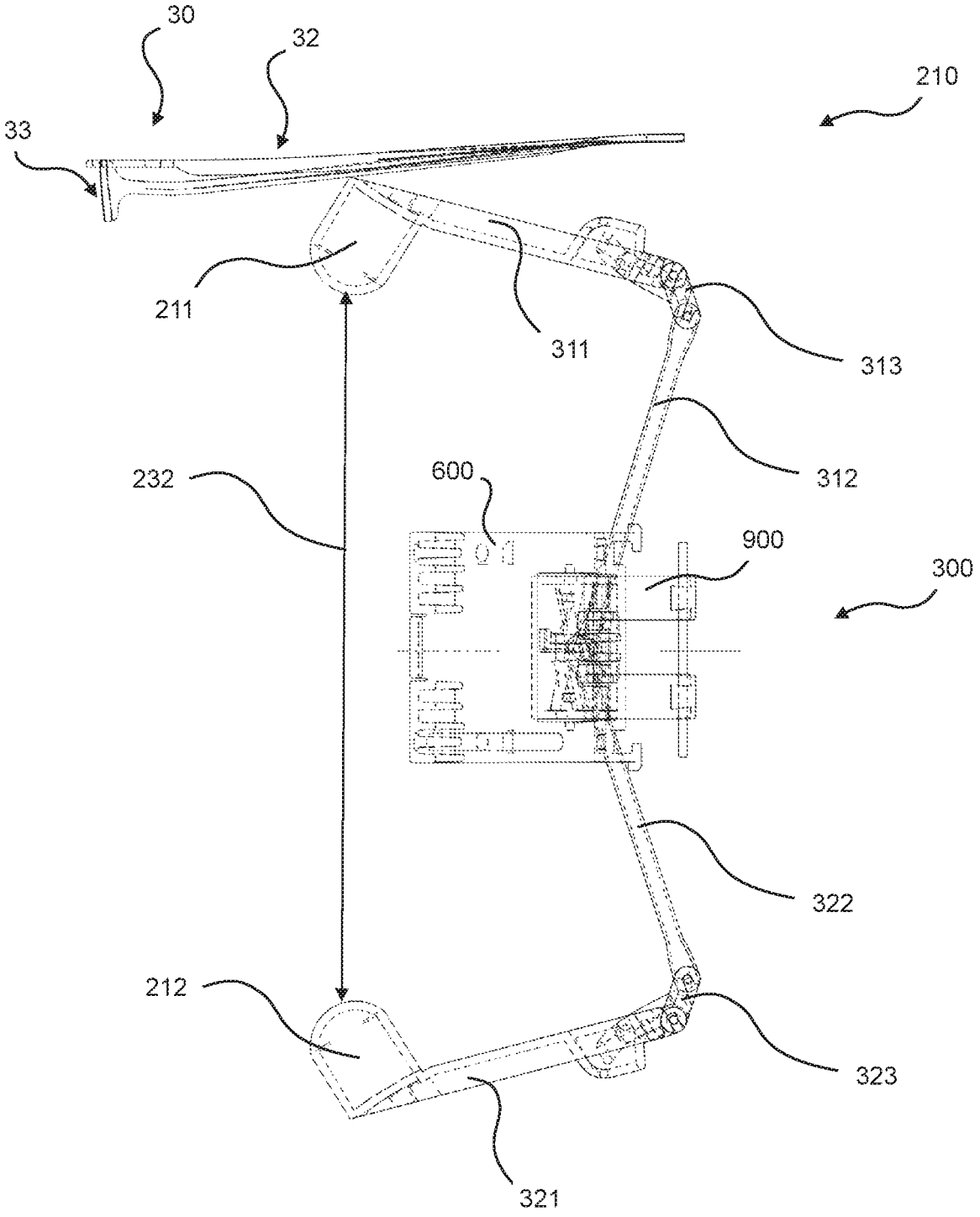
FIG. 11 shows a top view of the holding arrangement according to FIG. 9 with a level indicator.
Figure 12:
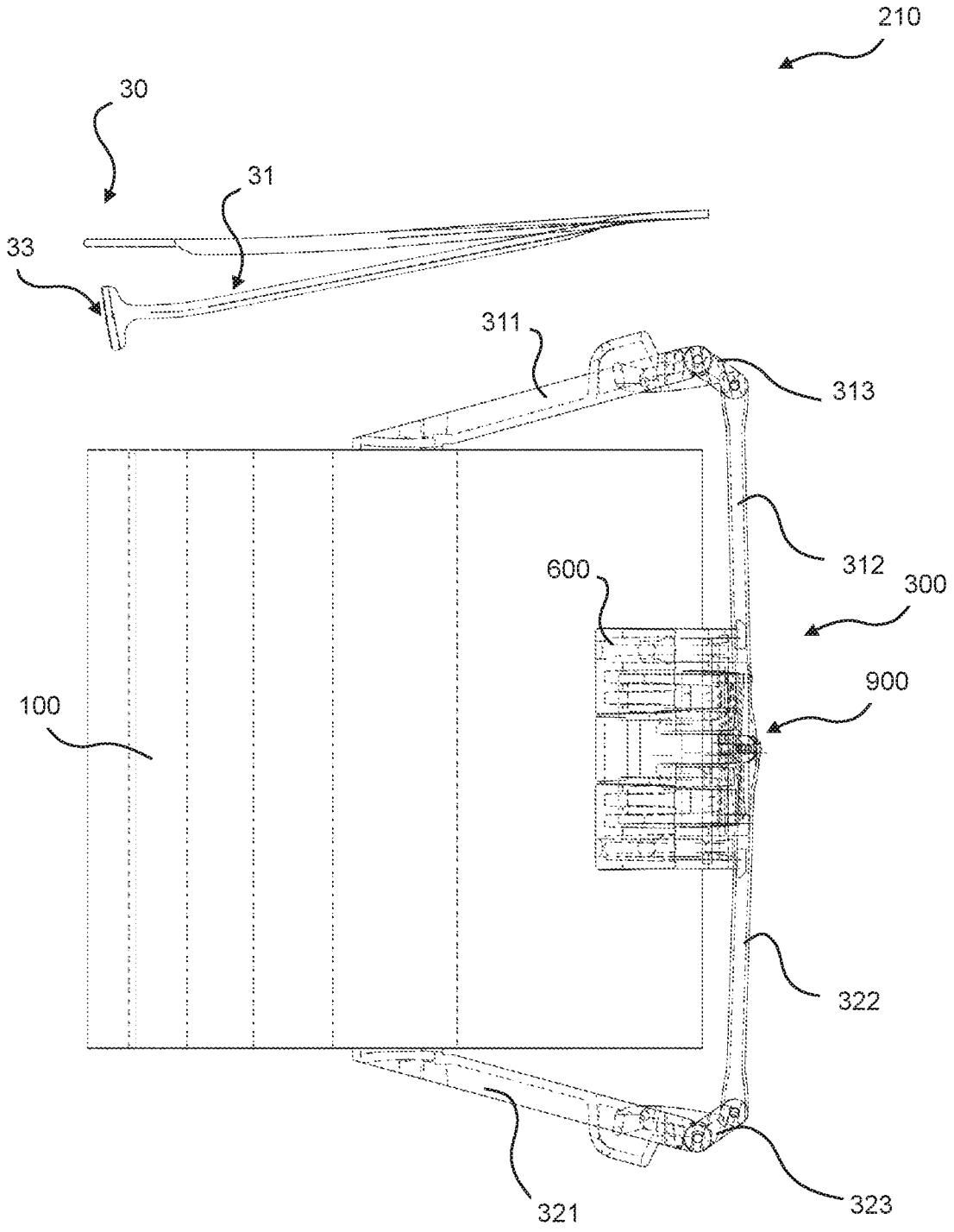
FIG. 12 shows a top view of the holding arrangement according to FIG. 10 with a level indicator.
Figure 13:
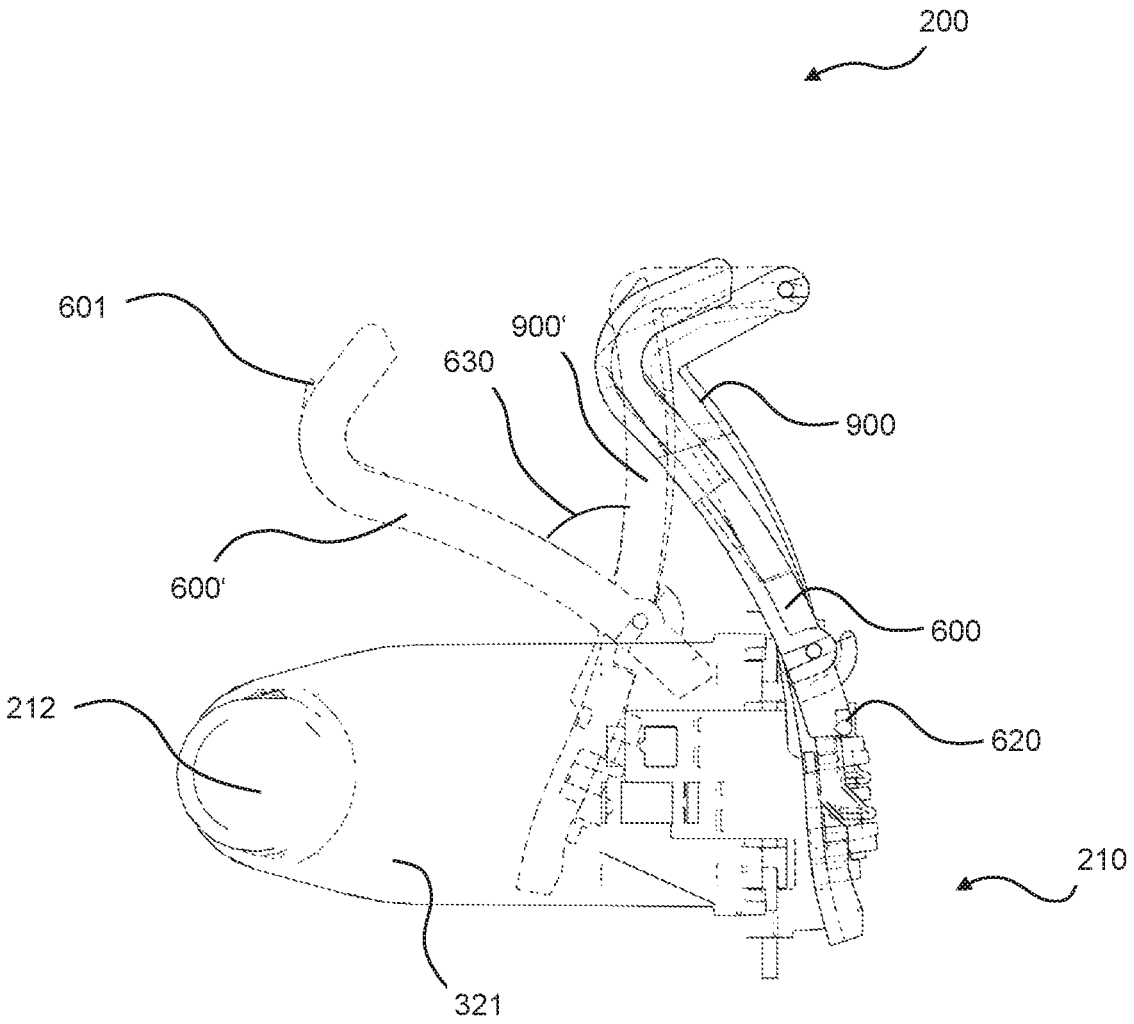
FIG. 13 shows a side view of the holding arrangement according to FIG. 9 with the diameter sensor and the transition element in different positions.
Figure 14:
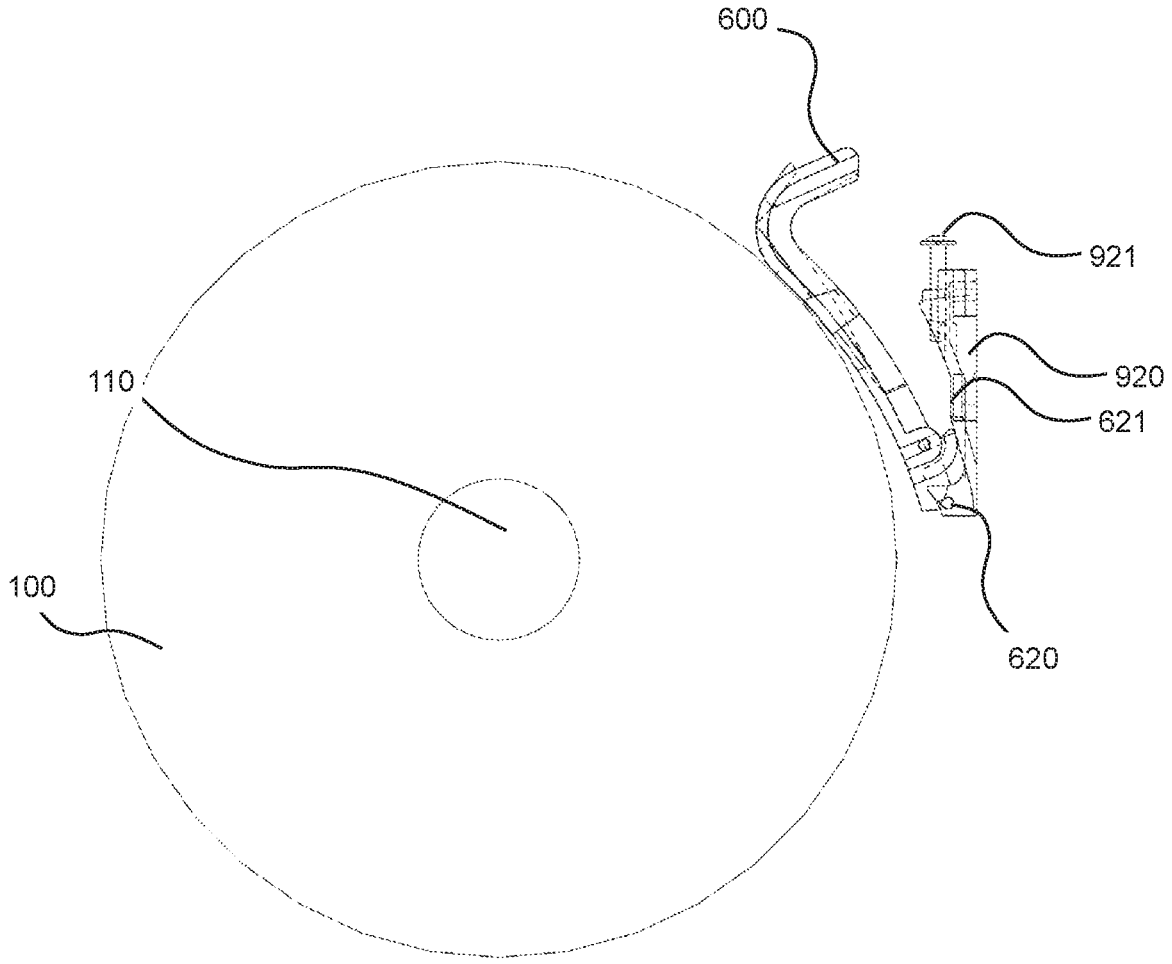
FIG. 14 shows a full tissue roll with the diameter sensor.
Figure 15:
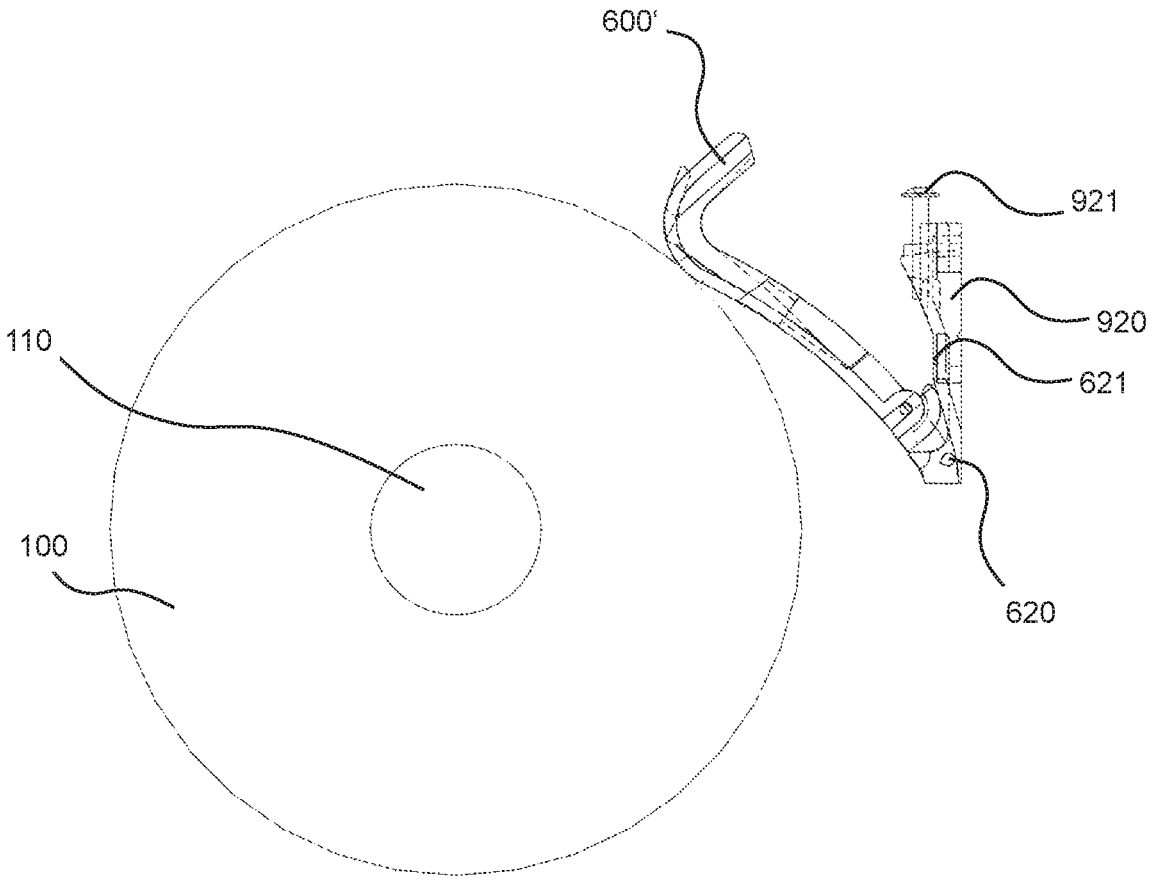
FIG. 15 shows a reduced diameter tissue roll with the diameter sensor.
Figure 16:
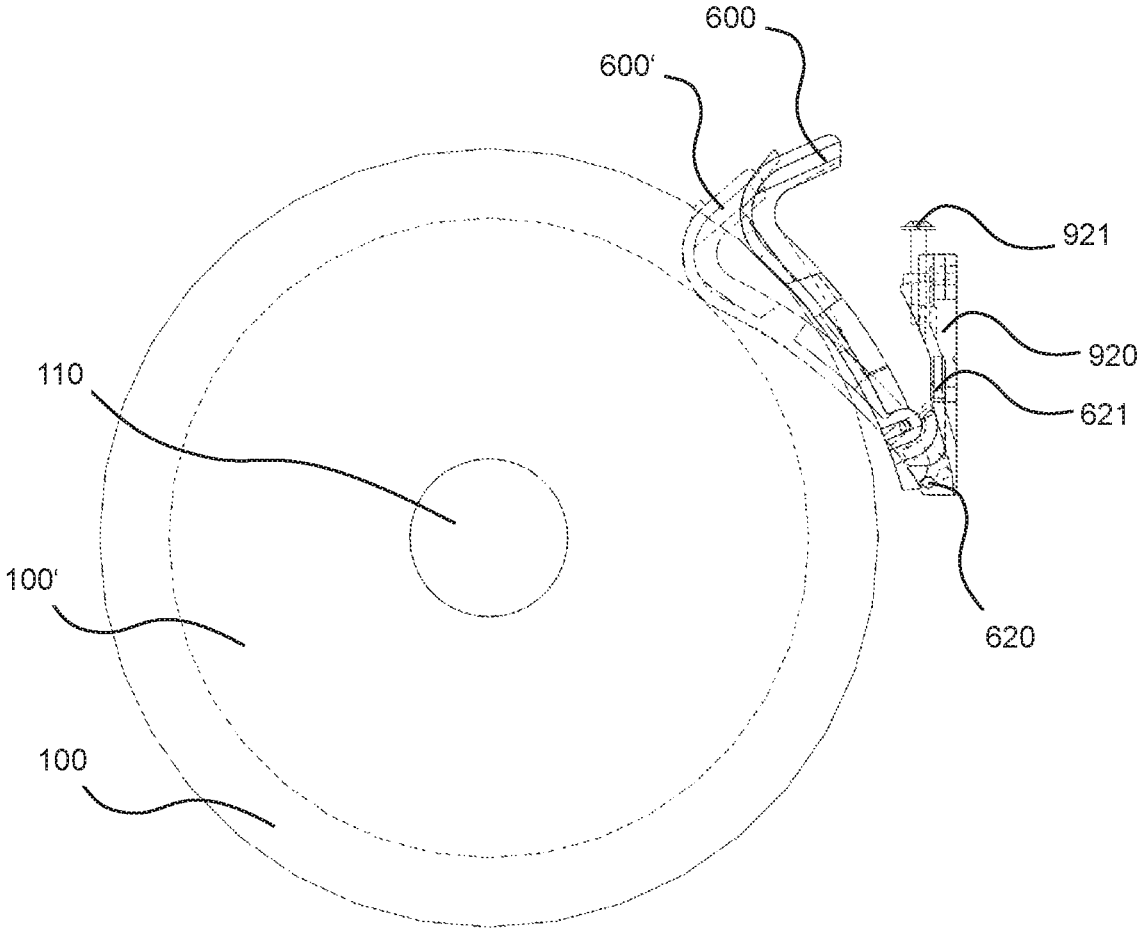
FIG. 16 shows both the full and the reduced diameter tissue roll with the diameter sensor in different positions.
Figure 17:
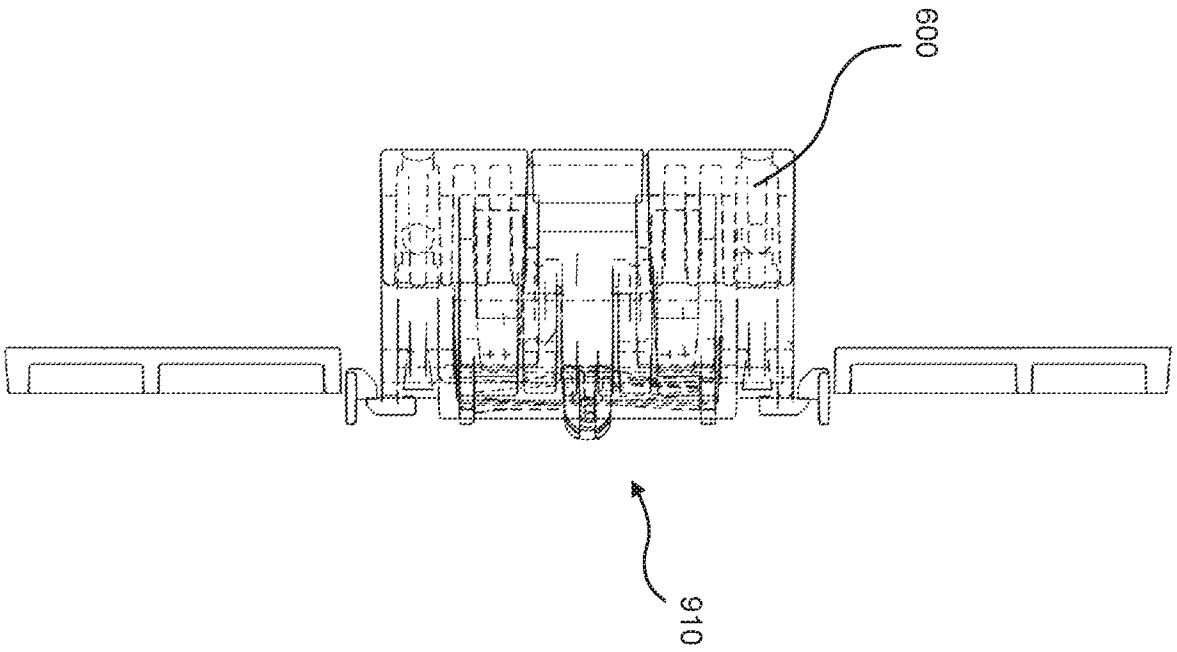
FIG. 17 shows a top view of an exemplary embodiment of a support insert.

As can be seen from FIGS. 11 and 12, a level indicator 30 with a base arm 32 and a level arm 31 is provided. At one end of the level arm 31 an indication surface 33 is provided. As can be seen when comparing FIG. 11 and FIG. 12, the level arm 31 is moved by the first holding arm 311 and the first holding element 211 to an outer position corresponding to an empty position of the first tissue roll position 119, while the level arm 31 is biased in an inner, filled position when the holding mechanism 210 is in the hold position as shown in FIG. 12.

The indication surface 33 is preferably viewable through the indicator opening 25 in the housing cover 22 such that service personnel can see through the indicator opening 25 whether or not there is a tissue roll 100 at the first tissue roll position 119, i.e., whether the holding mechanism 210 is in the hold position or in the release position without having to open the housing cover 22 of the dispenser 1.

The holding arrangement 200 further comprises a shift mechanism 300 for shifting the holding mechanism 210, in particular, the first and second holding elements 211, 212, from the hold position to the release position and vice versa. The shift mechanism 300 comprises a transition element 900, which is pivotably connected to a diameter sensor 600. The shift mechanism 300 is mounted on the housing base 21, preferably via the support insert 910. The shift mechanism 300 further comprises a toggle mechanism. In particular, the shift mechanism 300 further comprises first and second connection arms 312, 322 projecting from the transition element 900 and first and second transition pieces 313, 323 pivotably connecting the first and second holding arms 311, 321 to the first and second connection arms 312, 322.

The diameter sensor 600 is adapted to change its position with the changing, in particular, decreasing, diameter of the tissue roll 100, as can be seen, in particular, in FIGS. 13 through 16. Therein, the diameter sensor is shown in a full diameter position 600 and a reduced diameter position 600'. An angle 630 between the diameter sensor 600' and the transition element 900' in the release position is larger than the respective angle in the hold position. These Figures further show a guide frame 920 with a contoured guide surface 621, which can be adjusted by an adjustment element 921. A guide element 620 is provided on the diameter sensor 600. As can be seen, the diameter sensor 600 changes its position and the guide element 620 moves towards the contoured guide surface 621 and makes contact with it as the diameter of the tissue roll 100 decreases. Due to the contour of this guide surface 621, the guide element 620 slides along the guide surface 621 and effects an upward and lateral movement of the diameter sensor 600. This upward and lateral movement of the diameter sensor 600 effected by the interaction of the guide element 620 with the contoured guide surface 621 unlocks the locking element 610 of the diameter sensor.

The diameter sensor 600 has two locking elements 610 (cf. FIGS. 9 and 10, for example) for locking the diameter sensor 600 in the housing base 21, in particular, in a support insert 910 on the housing base 21. When the housing cover 22 and the first projection 23 thereon contacts the contact flip 601 on the diameter sensor 600, the locking elements 610 are snapped into their locked position in the support insert 910.

Once the locking elements 610 are unlocked by the upward and lateral movement of the diameter sensor 600 effected by the interaction of the guide element 620 with the contoured guide surface 621 in the reduced diameter position 600', the shift mechanism 300 shifts to hold mechanism 210 into the release position. In the release position, the tissue roll 100 is released from the first tissue roll position 119 and falls into the second tissue roll position 129. In order to decelerate this movement, stoppers 71 can be provided, as depicted in FIG. 21.

Figure 22:
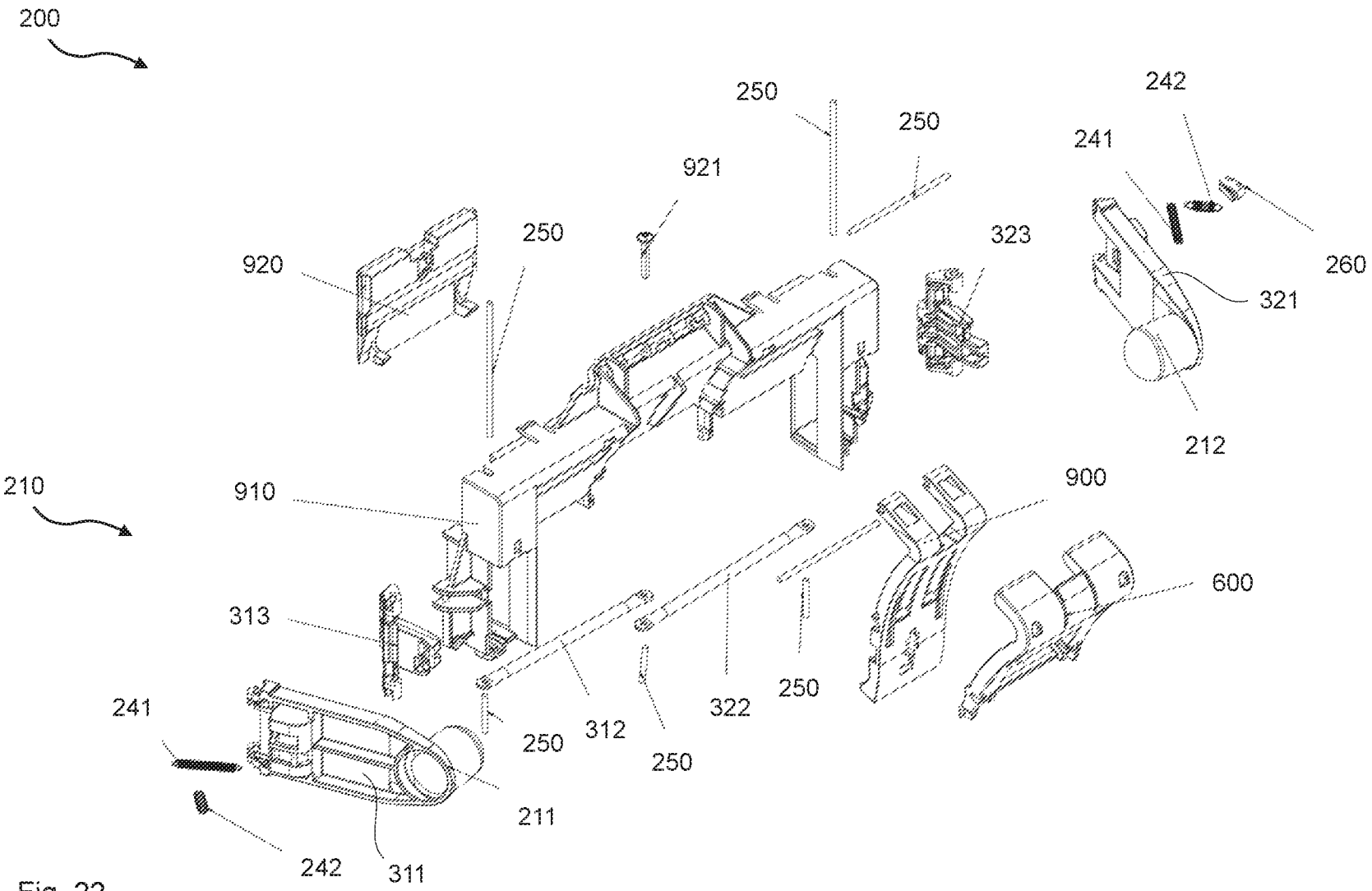
FIG. 22 shows an exploded view of an embodiment of a holding arrangement.

The shift mechanism 300 is biased in the release position, by two first biasing elements 241 in the form of springs, which connect the first transition piece 313 and the second transition piece 323 to the support insert 910 (cf. FIG. 22). As can be further seen from FIG. 22, the first holding arm 311 is connected to the first transition piece 313 via a second biasing element 242 and also the second holding arm 321 is connected to the second transition piece 323 via a second biasing element 242. Both second biasing elements 242 are in the form of springs. Pins 250 are preferably used for connecting various components. The two second biasing elements 242 are dimensioned smaller than the first biasing elements 241 and exert less force than the at least one first biasing element and into a different direction than the two first biasing elements 241 in order to brake or stop a movement initiated by the two first biasing elements 241. FIG. 22 further shows a number of pins for connecting the different elements of the holding arrangement 200.

A switch 260 is provided, which generates a signal indicating whether the hold mechanism 210 is in the hold position of in the release position. This signal is transferred to the dispenser module via a connector 451. In particular, it can be preferred that the transfer mechanism cannot be activated as long as the switch 260 indicates that the hold mechanism 210 is in the release position.

In the release position, the diameter sensor 600 and the lower end of the transition element 900 are spaced from the housing base 21, in particular, the support insert 910. When a new tissue roll 100 is inserted into the first tissue roll position 119, the tissue roll 100 is pushed against the diameter sensor 600 and the transition element 900 and thus the shift mechanism 300 and the hold mechanism 210 are brought against the biasing force into the hold position and the locking elements 610 are locked, preferably in the support insert 910 and further snapped into place by pressure exerted by the first protrusion 23 on the housing cover 22 upon closing of the housing 2. The insertion of a new tissue roll into the first tissue roll position 119 can be facilitated by providing lead wings 72, as depicted in FIG. 21.

As soon as the tissue roll has been released from the first tissue roll position 119 and has fallen into the second tissue roll position, the dispenser 1 can be provided with a new tissue roll by service personnel in the first tissue roll position 119 regardless of the direction of unrolling. By inserting the end of the new refill tissue roll into the transfer mechanism the dispenser 1 is ready for firstly completely using up the remaining tissue on the spare tissue roll in the second tissue roll position and subsequently transferring the end of the new refill tissue roll to the output mechanism automatically and without the need for service personnel or user interaction.

Figure 24:
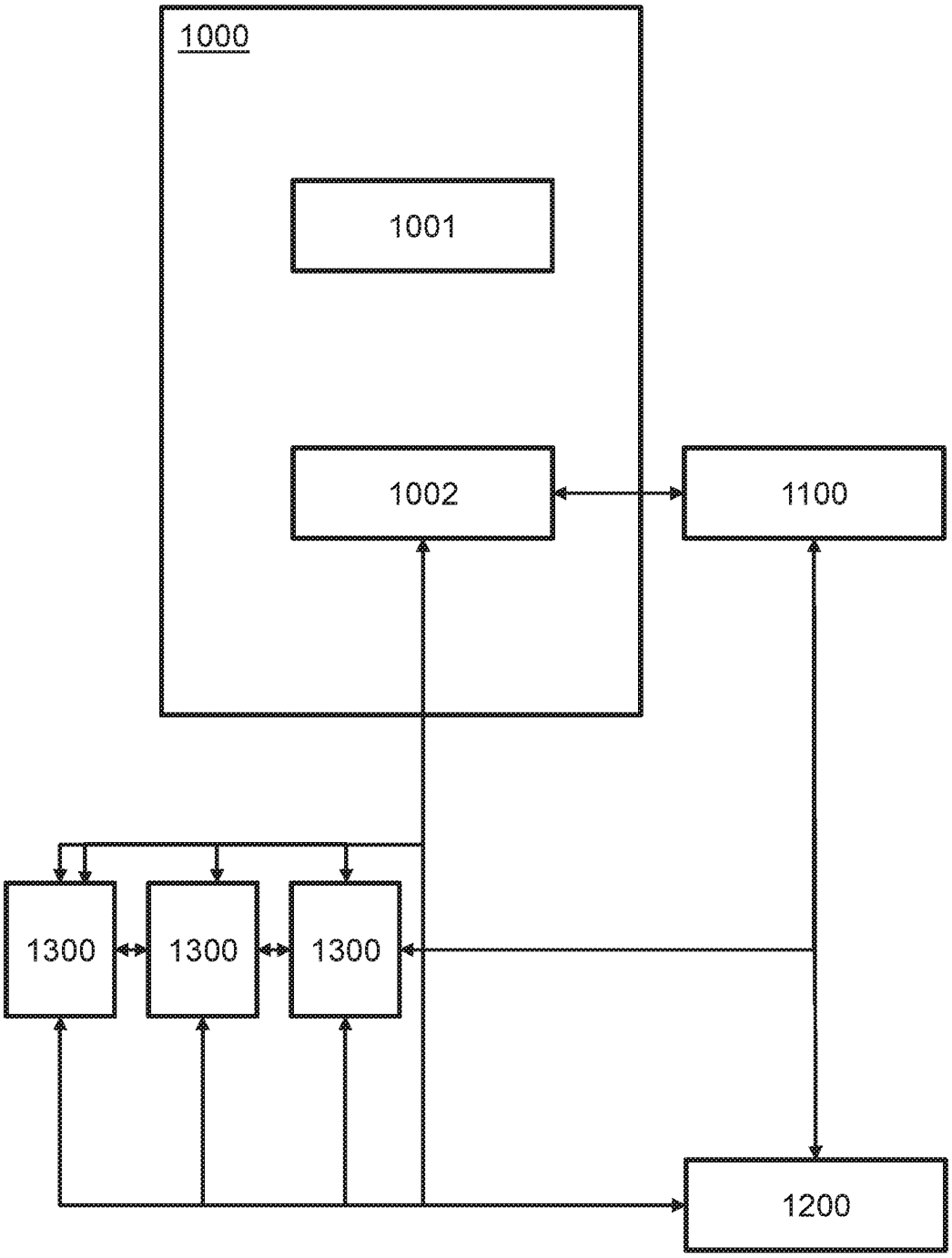
FIG. 24 shows a schematic diagram of an exemplary embodiment of an arrangement for detecting a filling level in a tissue dispenser.

In FIG. 24, a schematic diagram of an exemplary embodiment of an arrangement 1000 for detecting a filling level in a tissue dispenser 1 is shown. the arrangement 1000 comprises a counter 1001 and a control unit 1002. The counter 1001 is adapted to count portions of the tissue dispensed by the tissue dispenser 1. The control unit 1002 is adapted to receive counter data from the counter 1001. It can be preferred that the control unit 1002 is identical to the control unit 16 of the dispenser 1.

Further, it can be preferred that the control unit 1002 and the control unit 16 are sub units of a higher-level unit, wherein the control unit 1002 and the control unit 16 can be located separately from each other and connected, in a wired or wireless way, or wherein the control unit 1002 and the control unit 16 can be located at the same position or in adjacent positions.

The control unit 1002 is adapted to determine an initial filling level depending on the counter data and an initial tissue type information. Further, the control unit 1002 is adapted to determine a verified filling level depending on the counter data when a roll exchange of a tissue roll 110 from a first tissue roll position 119 to a second tissue roll position 129 in the tissue dispenser 1 has occurred.

Further, an external communication unit 1100, a backend unit 1200, and a plurality of mobile devices 1300 is provided. Preferably, the control unit 1002, the external communication unit 1100, the backend unit 1200 and the plurality of mobile devices 1300 can all communicate with each other in a bidirectional and preferably wireless way. This allows for remote maintenance of the dispenser 1, also referred to as "Over-The-Air" (OTA) maintenance, including software updates and parameter settings. In particular, the inclusion of mobile devices 1300 in this communication system allows for easy access and remote maintenance of the dispenser 1, a preferably a large number of dispenser 1, by service personnel.

It can also be preferred that the external communication unit 1100 is optional. In such a case, the communication takes place preferably between the control unit and the backend unit 1200 and/or between the control unit the plurality of mobile devices 1300.

Further preferably, a role management is provided to define which roles have which rights, e.g., regarding software updates, changes of settings, etc. Preferably, the role settings can be stored in the control unit 1002 and/or the external communication unit 1100 and/or the backend unit 1200 and/or the plurality of mobile devices 1300. Further preferably, the role settings can be set up and changed only in the external communication unit 1100 and/or the backend unit 1200. In this way, in the control unit 1002 and the mobile devices 1300, only the operations allowed by the role management can be carried out. This reduces the risk of unwanted manipulation or amendment of certain parameters and/or states and enhances reliability and accuracy in that certain manipulations can only be carried out by a certain role, wherein it is preferably ensured that the persons in these role have the required competence and experience.

For example, the mobile device 1300 can be used by service personnel in the installation phase, where service personnel equipped with mobile device 1300 walk through the facility where a plurality of tissue dispensers 1 is installed. The service personnel can preferably identify individual tissue dispensers 1 or groups of tissue dispenser 1 with the mobile device 1300, e.g., via scanning of a computer readable code on the tissue dispensers 1 or via image recognition. The identified tissue dispenser(s) 1 can then be assigned a location and/or position and/or group affiliation and/or provided with initial information (e.g., initial tissue type information) and/or initial operating parameters. Further, preferably, during further regular maintenance visits of the tissue dispenser(s) 1, the service personnel can update information about the tissue dispenser(s) 1, e.g., certain fault states or other issue notice in the maintenance visit via the mobile devices 1300.

At the same time, it can be preferred that software updates and parameter settings can be provided to or amended in individual tissue dispensers 1 or groups of tissue dispensers 1 remotely from the external communication unit 1100 and/or the backend unit 1200. For example, the external communication unit 1100 and/or the backend unit 1200 may be located in a central office location of accessible from such a location, where persons with a role having full rights can enter and/or choose information and/or data and/or signals to be communicated to the tissue dispenser(s) 1.

In particular, the control unit 1002 is adapted to carry out the steps described in the following with reference to the method 2000 for detecting a filling level in a tissue dispenser 1.

Figure 26:
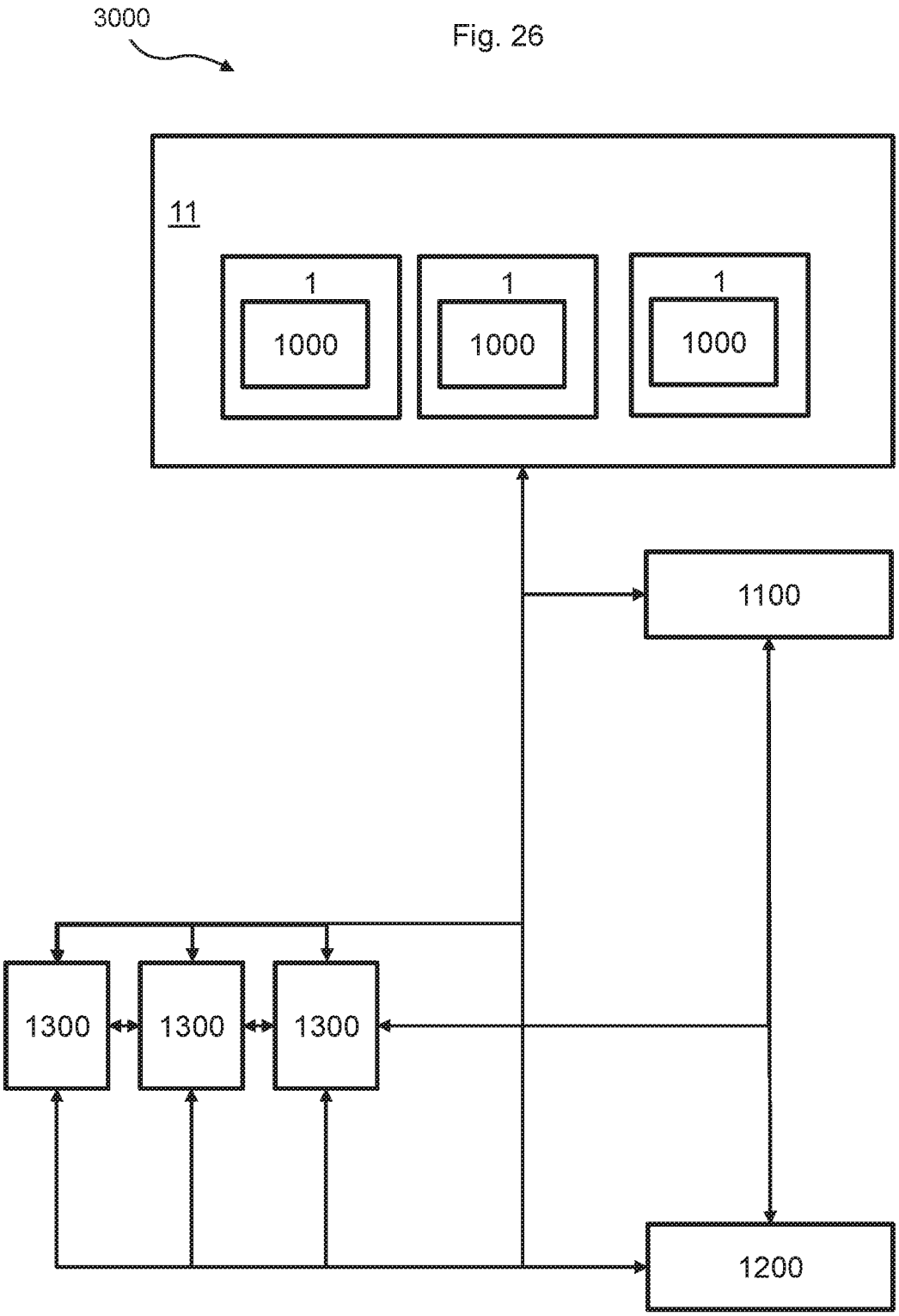
FIG. 26 shows a schematic diagram of an exemplary embodiment of a dispenser system.

FIG. 26 shows a dispenser system 3000 comprising, a plurality 1111 of tissue dispensers 1 as described herein, an (optional) external communication unit 1100, a backend unit 1200, and a plurality of mobile devices 1300.

Figure 25:
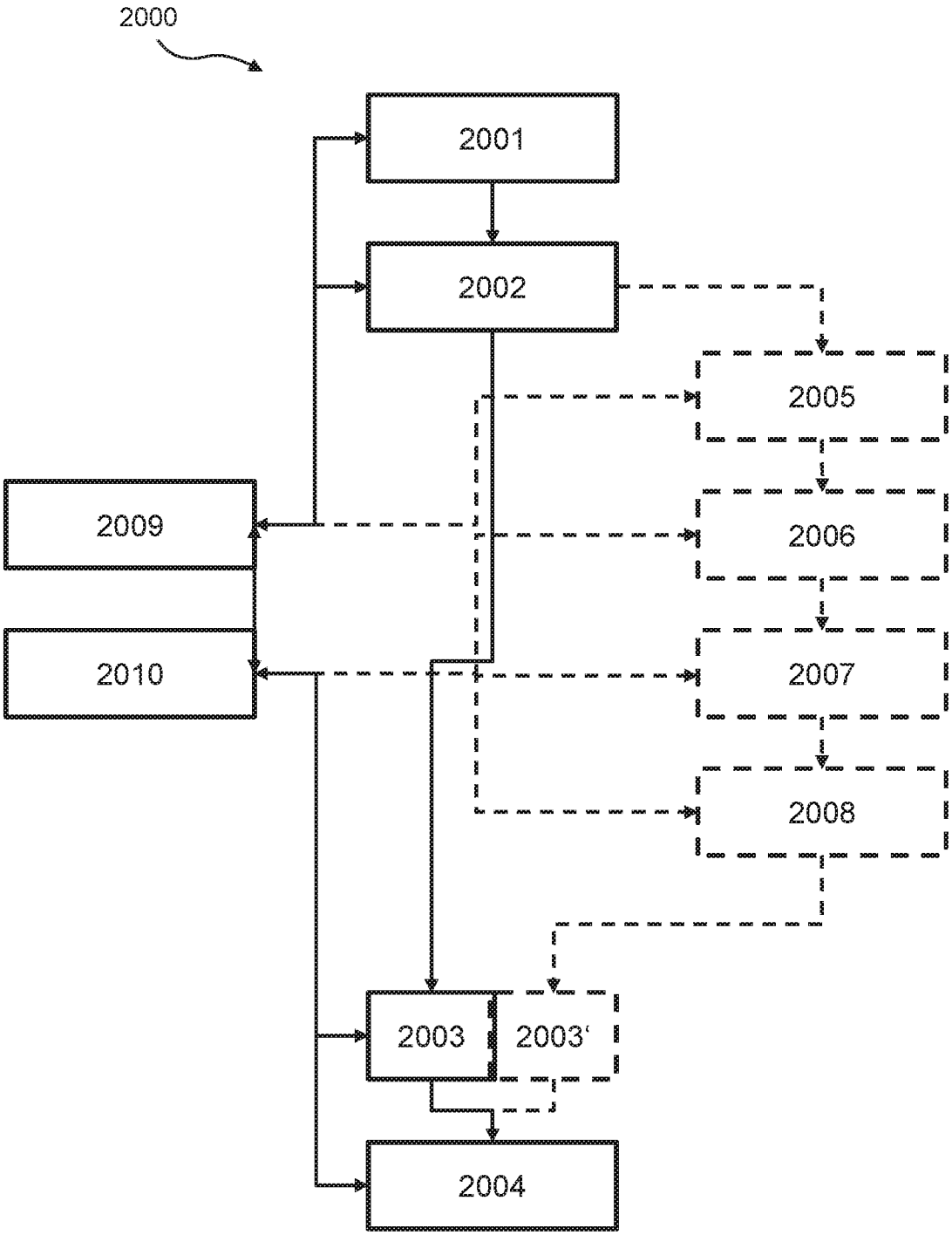
FIG. 25 shows a schematic flow diagram of an exemplary embodiment of a method for detecting a filling level in a tissue dispenser.

FIG. 25 shows a schematic flow diagram of an exemplary embodiment of a method 2000 for detecting a filling level in a tissue dispenser 1. The method 2000 comprises counting 2001 portions of the tissue dispensed by the tissue dispenser 1, determining 2001 an initial filling level depending on the counter data and an initial tissue type information, and determining 2002 a verified filling level depending on the counter data when a roll exchange of a tissue roll 110 from a first tissue roll position 119 to a second tissue roll position 129 in the tissue dispenser 1 has occurred. Preferably, the method 2000 further comprises determining 2003 a verified tissue type information when a roll exchange of a tissue roll 110 from a first tissue roll position 119 to a second tissue roll position 129 in the tissue dispenser 1 has occurred. Preferably, the method 2000 further comprises adjusting 2004 the size of the portions of the tissue dispensed by the tissue dispenser 1; in particular, after a roll exchange of a tissue roll 110 from a first tissue roll position 119 to a second tissue roll position 129 in the tissue dispenser 1 has occurred and/or after a refill of a tissue roll 100 to the first tissue roll position 119 has occurred.

Optionally and preferably, the method 2000 further comprises determining 2005 a roll exchange of a tissue roll 110 from a first tissue roll position 119 to a second tissue roll position 129 in the tissue dispenser 1, preferably by receiving a signal from a holding arrangement 200 that the holding arrangement 200 has taken a release position, and/or determining 2006 that a new tissue roll 110 has been received in the first tissue roll position 119, preferably by receiving a signal from a holding arrangement 200 that the holding arrangement 200 has taken a hold position; and/or determining 2007 that the second tissue roll position 129 is empty, preferably by receiving a signal from a detector 700 for detecting whether the second tissue roll position 129 is empty; and/or determining 2008 that a tissue roll 110 is present in the second tissue roll position 129, preferably by receiving a signal from a detector 700 for detecting that a tissue roll 110 is present in the second tissue roll position 129.

Preferably, the method 2000 further comprises determining 2003' the filling level depending on presence and/or absence of a tissue roll in the first tissue roll position 119, and/or presence and/or absence of a tissue roll in the second tissue roll position 129, and/or a refill of a new tissue roll in the first tissue roll position 119, and/or roll exchange of a tissue roll from a first tissue roll position to a second tissue roll position 129.

These steps 2005 through 2008 preferably take place between steps 2002 and 2003'. Since steps 2005 through 2008 and 2003' are optional, they are depicted in broken lines in FIG. 25.

Preferably, the method 2000 further comprises communicating 2009 with an external communication unit 1100 and/or a backend unit 1200, preferably in a bidirectional way and/or in a wireless way; and/or determining 2010 and/or saving and/or communicating information regarding one or more of the following: initial filling level, verified filling level, time stamp, initial tissue type information, verified tissue type information, portion size, in particular, currently dispensed portion size and/or comfort portion size and/or eco portion size, number of dispensed portions per tissue roll 110, dispensing mode, presence and/or absence of a tissue roll in the first tissue roll position 119, presence and/or absence of a tissue roll in the second tissue roll position 129, a refill of a new tissue roll in the first tissue roll position 119, roll exchange of a tissue roll from a first tissue roll position 119 to a second tissue roll position 129, settings for a proximity sensor of the tissue dispenser 1, energy supply level, technical status, number of dispensed portions without portion removal or portion retraction, number of total dispensed portions over product lifecycle, alerts and/or settings for alerts, location and/or position and/or group assignment of the tissue dispenser 1.

These steps 2009 and 2010 can take place parallel, prior to, or after any of the other steps. Since steps 2009 and 2010 are optional, they are depicted in broken lines in FIG. 25.

In the following two tables, two examples for a method 2000 carried out with an arrangement 1000 in a tissue dispenser 1 are depicted and will be described below.

from which tissue is currently dispensed ("rest length"), the filling level calculated and the filling level displayed at the tissue dispenser 1 as well as the used portions, i.e., the number of portions of tissue used in the preceding interval of a dispensing cycle.

The columns of the tables represent information at different times, with the leftmost column being the earliest, initial time and the time increases to the right.

In the first example, a tissue roll is inserted into the first tissue roll position 119 and, after its transfer to the second tissue roll position 129, fully depleted without a new tissue roll being installed in the first tissue roll position 119. Only when this tissue roll has been fully depleted, a new tissue roll is installed in the first tissue roll position 119 in this first example.

In the second example, after the tissue roll has been transferred from the first tissue roll position 119 to the second tissue roll position 129, a fresh tissue roll is installed in the first tissue roll position 119.

The first seven columns of both examples are identical: In both examples, a roll with a roll length of 150 m has been installed in the first tissue roll position 119 with the second tissue roll position 129 being empty. As this is the initial state of the tissue dispenser 1, the counter data of the counter 1001 is zero. The portion size is 25 cm. Thus, the values for the presence of a tissue roll in the first tissue roll position 119 ("new roll") is "true" and the value for the presence of a tissue roll in the second tissue roll position 129 ("rest roll active") is "false." Both calculated and displayed filling levels are 100% and also the rest length is identical to the roll length and is 150 m.

The number of used portions in this initial state is zero, since a new dispensing cycle has begun and no tissue portions have been dispensed in a preceding interval.

Example 1: Roll fully used

| | | | | | | | | | | | | | |
|---|---|---|---|---|---|---|---|---|---|---|---|---|---|
| Roll Length | 150 | 150 | 150 | 150 | 150 | 150 | 150 | 150 | 150 | 150 | 150 | 150 | 150 |
| Portion Counter | 0 | 100 | 200 | 300 | 400 | 480 | 520 | 560 | 600 | 630 | 0 | 60 | 120 |
| Potion Size | 25 | 25 | 25 | 25 | 25 | 25 | 20 | 20 | 20 | 20 | 25 | 25 | 25 |
| New Roll | true | true | true | true | true | true | false | false | false | false | true | true | true |
| Rest Roll active | false | false | false | false | false | false | true | true | true | true | false | false | false |
| Rest Length | 150 | 125 | 100 | 75 | 50 | 30 | 22 | 14 | 6 | 0 | 150 | 135 | 120 |
| Filling Level Calculat | 100% | 83% | 67% | 50% | 33% | 20% | 15% | 9% | 4% | 0% | 100% | 90% | 80% |
| Filling Level Dispaye | 100% | 83% | 67% | 50% | 33% | 20% | 15% | 9% | 4% | 0% | 100% | 90% | 80% |
| Used Portions | 0 | 100 | 100 | 100 | 100 | 80 | 40 | 40 | 40 | 30 | 0 | 60 | 60 |

Example 2: Restroll active + Roll refill

| | | | | | | | | | | | | | |
|---|---|---|---|---|---|---|---|---|---|---|---|---|---|
| Roll Length | 150 | 150 | 150 | 150 | 150 | 150 | 150 | 150 | 150 | 150 | 150 | 150 | 150 |
| Portion Counter | 0 | 100 | 200 | 300 | 400 | 480 | 520 | 560 | 600 | 608 | 0 | 60 | 120 |
| Potion Size | 25 | 25 | 25 | 25 | 25 | 25 | 20 | 25 | 25 | 25 | 25 | 25 | 25 |
| New Roll | true | true | true | true | true | true | false | true | true | true | true | true | true |
| Rest Roll active | false | false | false | false | false | false | true | true | true | true | false | false | false |
| Rest Length | 150 | 125 | 100 | 75 | 50 | 30 | 22 | 12 | 2 | 0 | 150 | 135 | 120 |
| Filling Level Calculat | 100% | 83% | 67% | 50% | 33% | 20% | 15% | 8% | 1% | 0% | 100% | 90% | 80% |
| Filling Level Dispaye | 100% | 83% | 67% | 50% | 33% | 20% | 15% | 100% | 100% | 100% | 100% | 90% | 80% |
| Used Portions | 0 | 100 | 100 | 100 | 100 | 80 | 40 | 40 | 40 | 8 | 0 | 60 | 60 |

In both tables, the lines contain information about the roll length, the counter data of the portion counter 1001, information with regard to the portion size, whether a tissue roll 110 is present in the first tissue roll position 119 ("new roll" true or false), whether a tissue roll 110 is present in the second tissue roll position 129 ("rest roll active" true or false), the tissue length remaining on the tissue roll 110, The next four columns show the development of the values after the counter data has incremented for 100 portions for each column. The counter data of the counter 1001 increases accordingly to 100, 200, 300, and 400, respectively and the rest length decreases accordingly. The roll length in the first line does not decrease, since it is a general information about the maximum roll length of the tissue roll 110. The filling levels decrease accordingly. The number of used portions is 100, since in each of the intervals between the columns, 100 portions have been dispensed.

The sixth column represents the time when 480 portions have been counted by the counter 1001. The seventh column represents the time when 520 portions have been counted by the counter 1001. Thus, the number of used portions is 80 and 40, respectively, in these columns.

The tissue dispenser 1 is adapted such that when about 500 portions of a tissue roll 110 with a roll length of 150 m have been dispensed, the diameter of the tissue roll 110 has decreased sufficiently, such that the tissue roll 110 will move from the first tissue roll position 119 to the second tissue roll position 129. This can be seen in the seventh column of the two examples in that the values for "new roll" and "rest roll active" have changed.

Further, when a roll exchange occurs, the portion size is reduced from 25 cm to 20 cm, i.e., from a comfort size to an eco-size such that the remaining length of tissue lasts for longer.

Once the values for "new roll" and "rest roll active" change, i.e., at the time when a roll exchange of a tissue roll 110 from a first tissue roll position 119 to a second tissue roll position 129 in the tissue dispenser 1 has occurred, a verified filling level can be determined.

For example, in the present two examples, the tissue dispenser 1 and its first and second tissue roll positions 119, 129 and the diameter sensor 600 and the holding arrangement 200 as described above are adapted such that for a tissue roll 110 with a roll length of 150 m, the roll exchange will occur after about 500 portions have been dispensed. In the two examples depicted in the two tables, the tissue roll 110 installed in the tissue dispenser 1 does have a roll length of 150 m, and thus the initial tissue type information corresponds to the verified tissue type information. In the first six columns of the two tables, the filling levels are determined based on the initial tissue type information. In the seventh column, when the roll exchange has occurred, it can be determined whether the initial tissue type information has been correct and thus the filling level in the seventh column now is a verified filling level.

For example, if instead of a two-layer tissue roll with a roll length of 150 m a three-layer tissue roll with a roll length of 120 m would have been used, the roll exchange would have occurred earlier, i.e., when less than 500 portions would have been counted. In this case, the tissue type information would be adjusted and the filling level would be determined based on this verified tissue type information. In such a case where the roll exchange occurs earlier, the verified filling level would also be determined at the time of the roll exchange, e.g., in column 5 or 6 already.

In the first example, when the roll exchange has occurred, no new tissue roll is installed into the first tissue roll position 119 and thus the value for "new roll" remains "false" in columns 7 through 10. The tissue roll in the second tissue roll position 129 is fully depleted until the rest length is zero. In the last interval for this tissue roll in the second tissue roll position 129, thirty portions have been used.

After the tissue roll has been fully depleted, a new tissue roll is installed in the first tissue roll position 119 and the values for "new roll" and "rest roll active" are changed again. The counter data of the counter 1001 is reset to zero and the filling levels are reset to 100% accordingly. Further, also the portion size is reset to comfort size of 25 cm. Thus, a new dispensing cycle has begun.

Columns 11 through 13 are identical for both examples again.

In the second example, a new tissue roll is installed in the first tissue roll position 119 while the original tissue roll is still present in the second roll position 129. This can be seen in the second table in column 8, where the value for "new roll" changes from "false" to "true." Thus, in column 8 of the second example, a tissue roll is present in both tissue roll positions 119, 129. As long as the tissue roll in the second tissue roll position 129 is not yet fully depleted, the dispenser 1 will continue dispensing tissue from the tissue in the second roll position 129. Therefore, the calculated filling level will decrease accordingly. However, since a new tissue roll is already present in the first tissue roll position 119, the portion size can be increased again to comfort size of 25 cm once this tissue roll has been installed in the first tissue roll position 119. Further, also the displayed filling level is set back to 100%, since a full new tissue roll is present in the first tissue roll position 119. The displayed filling level only starts decreasing from 100% once the tissue roll in the second tissue roll position 129 is fully depleted and the transfer mechanism 500 has transferred the end of the tissue roll in the first tissue roll position 119 to the output mechanism 400 and the tissue dispenser 1 has started dispensing tissue from the tissue roll in the first tissue roll position 119, as can be seen in column 11.

Preferably, the filling level is calculated by dividing the rest length or remaining length by the portion size. The rest length or remaining length is preferably calculated by subtracting the used length (i.e., the number of portions dispensed times the portion size) from the previous rest or remaining length.

Further preferably, a new calculation of the values occurs at fixed intervals, which may be time intervals or intervals regarding a certain number of counted portions. Further, it is preferred that new calculations are triggered after a roll exchange has occurred and/or after the portion size has been adjusted and/or after the tissue roll in the second tissue roll position 129 is fully depleted and/or after a new tissue roll has been installed in the first tissue roll position 119.

Preferably, if both values for "new roll" and "rest from active" are true, the displayed filling level will always be 100%. Preferably, if "rest roll active" changes from "true" to "false" and "new roll" is true, the counter 1001 and the remaining length are reset.

Further preferably, information about better level, time stamp, technical status, etc., can be determined and communicated.

It is further preferred that alerts can be set if a refill of a tissue roll to the first tissue roll position 119 is not done after a certain amount of time or after a certain amount of portions have been dispensed. Further, repeated alerts can be set until a new tissue roll in the first tissue roll position 119 has been installed.

Preferably, once a roll exchange has occurred, information can be communicated that a refill roll is needed to be installed in the first tissue roll position 119 of the tissue dispenser 1. Based thereon, alerts to service personnel or their supervisor and management can be initiated.

In particular, the information about which tissue dispensers 1 need a refill can be used in the planning of maintenance of a large number of tissue dispensers 1 in a facility.

It is particularly preferred that current, in particular, real-time, information and/or historical information, preferably in the form of an overview, is available and communicated, for example, to the external communication unit 1100 and/or the backend unit 1200 and/or the mobile devices 1300.

In summary, with the solution described herein, the detection of a filling level can be much more reliable and accurate, since a defined event, namely the exchange of a tissue roll from the first tissue roll position to a second tissue roll position in the tissue dispenser, and the counter data present at this time, is used to verify the filling level which was originally determined based on an initial tissue type information and the counter data at this initial stage. The step of verifying the filling level at a predetermined event improves reliability and accuracy of the filling level detection.

Further, by including various information in the detection of the filling level and by communicating this information as described herein, the management of large amounts of tissue dispensers 1 in facilities is facilitated.

The invention claimed is:

1. A method for detecting a filling level in a tissue dispenser for dispensing portions of a continuous web of tissue from a tissue roll, the method comprising the steps of:

counting portions of the tissue dispensed by the tissue dispenser to generate counter data;

determining an initial filling level depending on the counter data and an initial tissue type information;

determining a verified filling level depending on the counter data when a roll exchange of a tissue roll from a first tissue roll position to a second tissue roll position in the tissue dispenser has occurred, and determining a verified tissue type information when a roll exchange of a tissue roll from a first tissue roll position to a second tissue roll position in the tissue dispenser has occurred, wherein the verified tissue type information is determined at the time of the roll exchange;

wherein the initial filling level corresponds to the filling level which is derived from the initial tissue type information with the counter data at the time of determination as long as no verified tissue type information has been determined;

wherein the verified filling level is determined taking into account the event of the change in position of the tissue roll and the counter data corresponding to this time of exchange of a tissue roll from a first tissue roll position to a second tissue roll position; and wherein the determination of the verified filling level depends on data relating to the roll exchange, namely a reduced diameter of the tissue roll at the time of the roll exchange and/or a maximum diameter of the tissue roll in the second tissue roll position, such that:

the initial tissue type information is an information which is set in a default;

the initial tissue type information corresponds to a standard tissue type;

the tissue type information comprises information on at least one or more of the following:

length of tissue on the tissue roll, number of layers, thickness of tissue, tissue material, and single use or multiuse tissue; or the initial filling level corresponds to the filling level which is derived from the initial tissue type information with the counter data at the time of determination as long as no verified tissue type information has been determined.

2. The method according to claim 1, comprising the further step of:

adjusting a size of a portion of the tissue roll dispensed by the tissue dispenser after the roll exchange of the tissue roll from the first tissue roll position to the second tissue roll position in the tissue dispenser has occurred; or adjusting the size of the portion of the tissue roll dispensed by the tissue dispenser after a refill of the tissue roll to the first tissue roll position has occurred.

3. The method according to claim 1, comprising the further step(s) of:

determining a roll exchange of the tissue roll from the first tissue roll position to the second tissue roll position in the tissue dispenser by receiving a signal from a holding arrangement that the holding arrangement has taken a release position;

determining that a new tissue roll has been received in the first tissue roll position by receiving a signal from a holding arrangement that the holding arrangement has taken a hold position;

determining that the second tissue roll position is empty by receiving a signal from a detector for detecting whether the second tissue roll position is empty; and/or determining that the tissue roll is present in the second tissue roll position by receiving a signal from a detector for detecting that the tissue roll is present in the second tissue roll position.

4. The method according to claim 1, wherein the step of determining the verified filling level depends on:

the presence or absence of the tissue roll in the first tissue roll position;

the presence or absence of the tissue roll in the second tissue roll position;

a refill of a new tissue roll in the first tissue roll position; and/or the roll exchange of the tissue roll from the first tissue roll position to the second tissue roll position.

5. The method according to claim 1, further comprising the step(s) of:

communicating with an external communication unit or a backend unit in a bidirectional way or in a wireless way; or determining, saving, or communicating information regarding one or more of the following:

the initial filling level, the verified filling level, a time stamp, an initial tissue type information, a verified tissue type information, a portion size, a number of dispensed portions per tissue roll, a dispensing mode, the presence or absence of the tissue roll in the first tissue roll position, the presence or absence of the tissue roll in the second tissue roll position, a refill of a new tissue roll in the first tissue roll position, a roll exchange of the tissue roll from the first tissue roll position to the second tissue roll position, a setting for a proximity sensor of the tissue dispenser, an energy supply level, a technical status, a number of dispensed portions without portion removal or portion retraction, a number of total dispensed portions over a lifecycle of the tissue dispenser, an alert or a setting for alerts, and/or a location, position, or group assignment of the tissue dispenser.

6. An arrangement for detecting a filling level in a tissue dispenser for dispensing portions of a continuous web of tissue from a tissue roll, the arrangement comprising:

a counter adapted to count portions of the tissue dispensed by the tissue dispenser and adapted to generate counter data; and a control unit adapted to receive counter data from the counter, wherein the control unit is adapted to determine a verified filling level depending on the counter data when a roll exchange of the tissue roll from a first tissue roll position to a second tissue roll position in the tissue dispenser has occurred, wherein the control unit is adapted to determine a verified tissue type information when the roll exchange of the tissue roll from the first tissue roll position to the second tissue roll position in the tissue dispenser has occurred, and wherein the verified tissue type information is determined at the time of the roll exchange;

wherein the verified filling level is determined taking into account the event of the change in position of the tissue roll and the counter data corresponding to this time of exchange of a tissue roll from a first tissue roll position to a second tissue roll position, and wherein the determination of the verified filling level depends on data relating to the roll exchange, namely a reduced diameter of the tissue roll at the time of the roll exchange and/or a maximum diameter of the tissue roll in the second tissue roll position, such that:

the control unit is adapted to determine an initial filling level depending on the counter data and an initial tissue type information;

the initial tissue type information is an information which is set in a default, the initial tissue type information corresponds to a standard tissue type, the tissue type information comprises information on at least one or more of the following:

length of tissue on the issue roll, number of layers, thickness of tissue, tissue material, single use or multiuse tissue; or the initial filling level corresponds to the filling level which is derived from the initial tissue type information with the counter data at the time of determination as long as no verified tissue type information has been determined.

7. The arrangement according to claim 6, wherein the control unit is adapted to adjust a size of a portion of the tissue roll dispensed by the tissue dispenser after a roll exchange of a tissue roll from the first tissue roll position to the second tissue roll position in the tissue dispenser has occurred or after a refill of the tissue roll to the first tissue roll position has occurred.

8. The arrangement according to claim 6, wherein:

the control unit is adapted to determine a roll exchange of the tissue roll from the first tissue roll position to the second tissue roll position in the tissue dispenser by receiving a signal from a holding arrangement that the holding arrangement has taken a release position;

the control unit is adapted to determine that a new tissue roll has been received in the first tissue roll position by receiving a signal from a holding arrangement that the holding arrangement has taken a hold position;

the control unit is adapted to determine that the second tissue roll position is empty by receiving a signal from a detector for detecting whether the second tissue roll position is empty; and/or the control unit is adapted to determine that the tissue roll is present in the second tissue roll position by receiving a signal from a detector for detecting that a tissue roll is present in the second tissue roll position.

9. The arrangement according to claim 6, wherein the control unit is adapted to determine the filling level depending on:

the presence or absence of the tissue roll in the first tissue roll position;

the presence or absence of a tissue roll in the second tissue roll position;

a refill of a new tissue roll in the first tissue roll position; and/or a roll exchange of a tissue roll from the first tissue roll position to the second tissue roll position.

10. The arrangement according to claim 6, wherein:

the control unit is adapted to communicate with an external communication unit or with a backend unit in a bidirectional way or in a wireless way; or wherein the control unit is adapted to determine, save, or communicate information regarding one or more of the following:

an initial filling level, a verified filling level, a time stamp, an initial tissue type information, a verified tissue type information, a portion size, a number of dispensed portions per tissue roll, a dispensing mode, the presence or absence of a tissue roll in the first tissue roll position, the presence or absence of a tissue roll in the second tissue roll position, a refill of a new tissue roll in the first tissue roll position, a roll exchange of a tissue roll from the first tissue roll position to the second tissue roll position, a setting for a proximity sensor of the tissue dispenser, an energy supply level, a technical status, a number of dispensed portions without portion removal or portion retraction, a number of total dispensed portions over a lifecycle of the tissue dispenser, an alert or setting for an alert, and a location, position, or group assignment of the tissue dispenser.

* * * * *